US010902963B2

(12) United States Patent
Gaudet et al.

(10) Patent No.: US 10,902,963 B2
(45) Date of Patent: Jan. 26, 2021

(54) DECAYED WASTE RETRIEVAL METHOD AND SYSTEM

(71) Applicant: ATOMIC ENERGY OF CANADA LIMITED, Chalk River (CA)

(72) Inventors: Michel Gaudet, Pembrok (CA); Neil Briden, Deep River (CA); Malcolm Clough, Pembrok (CA)

(73) Assignee: ATOMIC ENERGY OF CANADA LIMITED, Chalk River (CA)

( * ) Notice: Subject to any disclaimer, the term of this patent is extended or adjusted under 35 U.S.C. 154(b) by 36 days.

(21) Appl. No.: 16/444,081

(22) Filed: Jun. 18, 2019

(65) Prior Publication Data

US 2019/0304615 A1 Oct. 3, 2019

Related U.S. Application Data

(63) Continuation of application No. 14/388,534, filed as application No. PCT/CA2013/000293 on Mar. 28, 2013, now abandoned.

(30) Foreign Application Priority Data

Mar. 28, 2012 (CA) ..... 2772752

(51) Int. Cl.
*G21F 5/14* (2006.01)
*B66C 1/46* (2006.01)

(52) U.S. Cl.
CPC . *G21F 5/14* (2013.01); *B66C 1/46* (2013.01)

(58) Field of Classification Search
CPC .. B66C 1/46; B66C 1/101; B66C 1/42; B66C 1/427; B66C 1/44; G21F 5/14; G21F 5/005; B65G 47/908
See application file for complete search history.

(56) References Cited

U.S. PATENT DOCUMENTS

| | | | |
|---|---|---|---|
| 4,592,581 | A | 6/1986 | Howard et al. |
| 6,179,357 | B1 | 1/2001 | Gabriel |
| 2006/0119117 | A1 | 6/2006 | Goubet et al. |

FOREIGN PATENT DOCUMENTS

| | | |
|---|---|---|
| DE | 230732 | 12/1985 |
| DE | 100 54 578 | 5/2002 |

(Continued)

OTHER PUBLICATIONS

International Search Report and Written Opinion from corresponding PCT Appln. No. PCT/CA2013/000293 dated Jul. 17, 2013.

(Continued)

*Primary Examiner* — Glenn F Myers
(74) *Attorney, Agent, or Firm* — Grossman, Tucker, Perreault & Pfleger, PLLC

(57) ABSTRACT

It is common to store decayed radioactive waste in waste packages, lowered into vertical concrete cylindrical storage containers called tile holes. These containers of these packages decay over time and may become fragile, making it difficult to remove them using conventional methods. A retrieval tool has been developed, comprising a cylinder that fits between the tile hole internal diameter and the outside diameter of the waste package inside the tile hole. Inflatable air wedges are equally spaced inside the cylinder. The air wedges are inflated to a low pressure (2.1 psig) to provide uniform grip to the outside of the packages, minimizing the risk of damage to the decayed containers. A back-up system uses horizontal safety bars at the bottom of the cylinder, which may be rotated to form a partial platform under the waste package, preventing the package from falling in the event of a failure.

24 Claims, 29 Drawing Sheets

(56) References Cited

FOREIGN PATENT DOCUMENTS

| | | |
|---|---|---|
| EP | 0 633 215 | 1/1995 |
| FR | 2523564 | 9/1983 |
| FR | 2 649 087 | 1/1991 |

OTHER PUBLICATIONS

International Preliminary Report on Patentability from corresponding PCT Appln. No. PCT/CA2013/000293 dated Oct. 1, 2014.
European Search Report from corresponding EP Appln. No. 13767819 dated Nov. 2, 2015.

DECAYED WASTE RETRIEVAL METHOD AND SYSTEM

FIELD

The present invention relates to retrieval systems and more specifically, to a device and system for lifting and/or moving objects that cannot be gripped and lifted safely and reliably by readily available, conventional means.

BACKGROUND

It is common to store decaying radioactive waste in vertical concrete cylindrical storage containers called tile holes. Within these tile holes are waste packages, which are formed in part by plastic and metal waste containers containing various levels of decayed radioactive wastes. These waste packages were originally loaded into the tile holes by a wire rope leader attached to the waste package. After each waste package was lowered into the tile hole, the wire leader was cut and the remaining length of wire remained attached to the waste package.

The tile holes are considered to be a temporary storage location. At some point the waste packages are to be retrieved, repackaged and put into a long term storage facility. Over time the containers have become degraded, with the plastic material of the waste containers being irradiated and becoming fragile, while the metal containers may have suffered from corrosion. Due to the degraded nature of the waste containers, retrieving these poses a significant safety risk as there is danger of the waste containers breaking apart.

Previous attempts made at retrieving decayed waste packages from tile holes have revealed that the existing retrieval tooling is inadequate. The waste container integrity after a number of years of storage introduced significant risk of failure and contamination if the waste container was damaged during the retrieval process. The method of retrieval currently available is to simply hook onto the wire that is attached to the waste packages and they are lifted out one at a time, using a crane. In a June 2010 retrieval campaign, two waste packages were successfully retrieved in this fashion. The operation was stopped when a leader detached from the third waste package, which prevented safe retrieval of the waste package using existing tooling. One of the waste packages retrieved from this tile hole was examined in one of Chalk River Laboratories hot cell facilities to evaluate the structural integrity of the plastic container.

The waste container shattered and broke apart when handled by manipulators, indicating that the waste containers had degraded over time.

It is not acceptable to have a retrieval system which may allow waste packages to fail and potentially release radioactive waste. There is therefore a need for an improved method and technology to lift waste packages safely from tile holes.

SUMMARY

It is an object of the invention to provide an improved method and system to lift waste packages from tile holes.

A retrieval tool has been designed and developed that comprises air bladders that are inflated to clamp around the periphery of a waste package without creating pressure points. There is also a safety backup system that deploys a support platform below the waste package once partial lifting has begun. Other features of the retrieval tool include spring loaded fingers to move the waste package from the walls of the tile hole, guiding the waste package into the retrieval tool. The spring loaded fingers were found to be effective for a specific waste package form, but may equally be a tapered leading edge for differing packages. The system also has a number of other advantageous features that include the release and activation mechanisms of the backup safety system.

The heart of the retrieval tool comprises a sheet metal cylinder fitted with air bladders (wedges) that fits into the tile hole and has sufficient clearance inside to accommodate the waste package to be gripped. The air wedges are filled with air from a supply source, to a pressure sufficient to grip the waste container. In a recent demonstration on actual degraded waste packages, a pressure of 2.1 PSIG safely gripped these straight-walled containers weighing up to 50 Kg.

A backup safety system was also incorporated into the retrieval tool, comprising vertical safety rods that allow safety bar arms to be rotated under the load to provide support to the bottom of the waste package. The safety bar arms are curved such that when the safety bar arms are in the open or stowed position they take the form of the sheet metal cylinder and remain out of the way whilst the waste package is entering into the retrieval tool.

This retrieval tool provides the first practical method for large scale retrievals of degraded and fragile decayed waste packages from temporary storage tile holes.

There may be other applications that require a tool to provide limited loading when lifting containers, packages or anything that may require gentle and even pressure during lifting.

The functionality of this tool was tested in a November 2011 retrieval campaign. The November 2011 retrievals retrieved a total of four waste packages, and included a waste package with a failed lift cable identified in the June 2010 retrieval campaign. It was a very successful test, given that the lid of the last waste package lifted was observed to be broken within the tile hole, with a brittle failure similar to that of the container previously examined in the Chalk River Laboratories facilities. All four waste packages were retrieved without incident or further damage to the waste containers. The November 2011 campaign demonstrated that degraded waste packages can be safely gripped and retrieved from tile holes, and that the system of the invention is a viable option for the relocation of waste packages to alternate engineered storage locations.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

These and other features of the invention will become more apparent from the following description in which reference is made to the appended drawings wherein:

FIG. 4 shows the six air wedges in a deflated state, while

DETAILED DESCRIPTION

Figure 1:
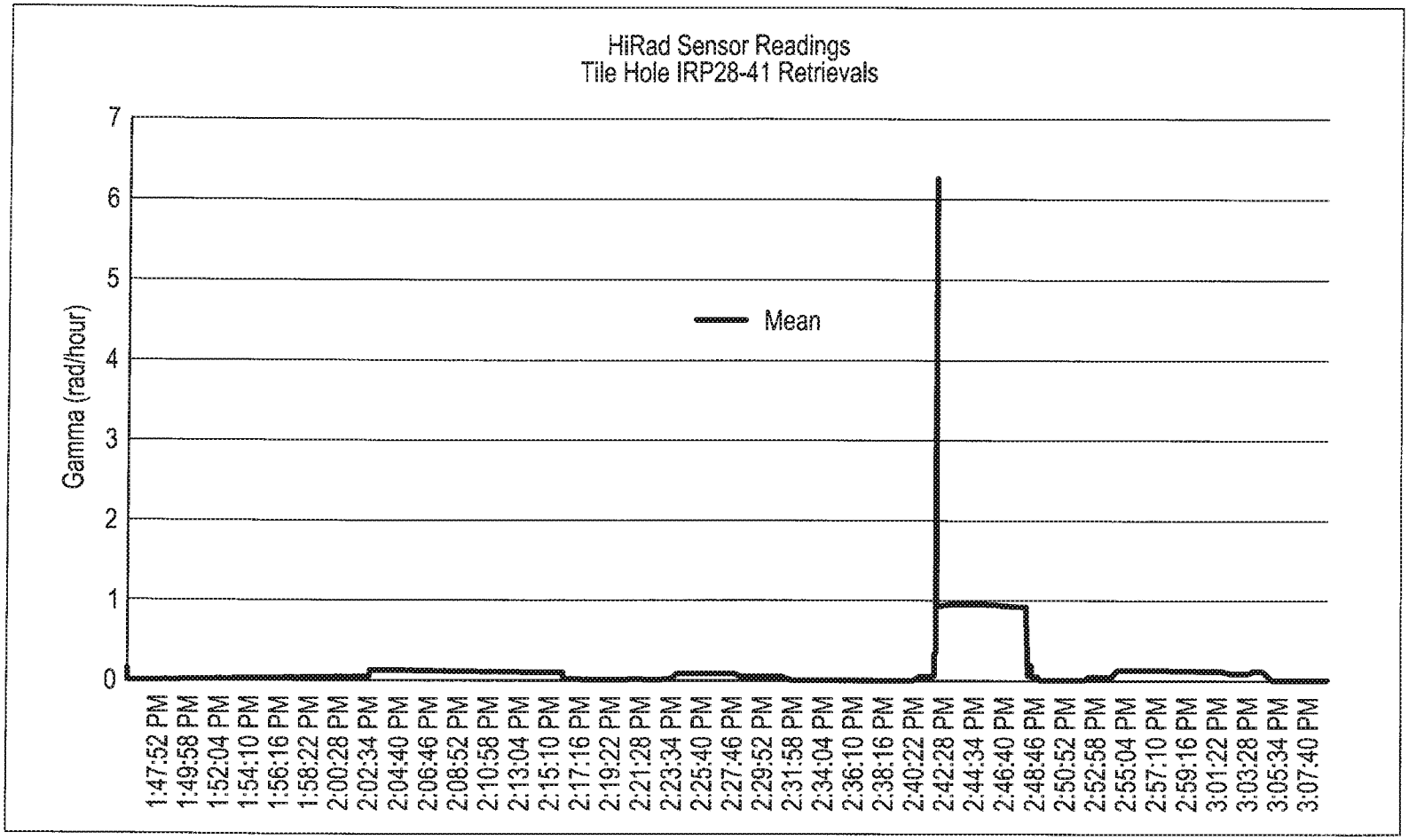
FIG. 1 shows a graph of gamma radiation dose rates during a retrieval exercise.

As explained above, recent attempts at retrieving decayed waste packages from tile holes have revealed that the existing retrieval tooling is inadequate. The waste container integrity after a number of years of storage introduced significant risk of failure and contamination if the waste container was damaged during the retrieval process. The current method of retrieval is to simply hook onto the wire leader that is attached to the waste packages and they are lifted out one at a time. Since some of the waste containers have degraded over time the risk of breaking the waste containers during retrieval is high.

A retrieval tool has been developed to address the problems in the art, employing six inflatable air wedges equally spaced inside the body of the retrieval tool. Any practical number of air wedges could be used, though for purposes similar to the one described, between 3 and 8 air wedges would generally be used. The tool body is in the form of a stainless steel cylinder that has been designed to fit between the tile hole internal diameter and the outside diameter of the waste package inside the tile hole. The air wedges are inflated to a low pressure (2.1 psig, for example) that is intended to provide a generally uniform pressure onto the outside of the waste packages to minimize the gripping force required to lift the waste packages. This will minimize the risk of damaging the decayed waste containers.

Also included in the design of the retrieval tool is a back-up system using "safety bars". There are six safety bars that fit between the air wedges, and are fabricated from steel bars oriented vertically. Again, any practical number of safety bars could be used, though for purposes similar to the one described, between 3 and 8 safety bars would generally be used. The lower end of each bar is fitted with a horizontal arm and onto each horizontal arm is mounted spring steel "fingers" or other suitable leading edge. Both the horizontal arm and the "fingers" are curved to match the profile of the retrieval tool. When the horizontal arms are in the stowed or open position, the fingers form a tapered lead-in to help guide the waste package into the retrieval tool. Once the air wedges are pressurized, the captured waste package is lifted a short distance, and the horizontal arms are dropped downwards and then rotated to the closed position. When the horizontal arms are in the deployed or closed position they form a partial platform under the waste package, preventing large pieces of material, or the entire package, from falling due to the collapse of the waste container or failure of the air wedges.

Another aspect of the retrieval system is the addition of a containment control bag specifically designed to be hooked onto the retrieval tool, to enclose the waste package and its contents when transferring the waste package from the tile hole across the ground to its designated overpackage.

Prototype tools were built to verify and demonstrate the use of a pneumatic gripping system to lift waste packages from tile holes. As shown in the successful retrieval of the waste package during a test, the retrieval tool provides a gentle means of gripping degraded and brittle waste containers without further damage to that waste container. Other observations include:

- The seam in the tile hole did not hinder the retrievals. This observation was noted only after the waste package at this location was engaged and lifted clear of the tile hole.
- A camera mounted on the retrieval tool was very useful, permitting monitoring of the process.
- The four waste packages that were lifted were all resting against the side of the tile hole wall which meant the retrieval tool had to move and centre the waste packages before engaging these, which occurred without difficulty.
- The tool incorporated a photodiode sensor, which was located 10-12 mm above the internal stop within the retrieval tool to detect radiation levels. A tablet computer was used to analyze the signal to give real-time field levels, and recorded these values in 1 second intervals. These have been plotted and included as FIG. 1. The four periods of elevated readings indicate the period of time in which the retrieval tool engaged a waste package.

Two primary prototype retrieval tools were developed: a Mark I tool and a later Mark II tool, both of which were built and tested. From observations made at the Mark I tool demonstration, there were a number of operating and design requirements to be included as part of the Design Inputs for the Mark II tool. The key inputs that were documented are as follows:

1. A tool is needed to cut the existing wire leader within the tile hole.
2. The retrieval tool shall preferably be able to move packages that are resting on the wall of the tile hole without crushing the edge of the waste container.
3. Provide a mechanism to ensure the Safety Bars remain fully open as the retrieval tool is lowered over each waste package.
4. The safety bars are to be firmly fixed in place, in the deployed (i.e. closed) position during retrieval of a package.
5. Consideration should be given to flaring the bottom of the retrieval tool (with a round edge) to assist in self-centering the waste package as the retrieval tool is lowered over it.
6. Ensure that only one waste package at a time is captured when the air bags are inflated.
7. Add a 'gentle' hard stop so the retrieval tool settles consistently on the top of the waste package before the air wedges are activated.
8. Add additional clearance between the internal diameter of the retrieval tool and the outside diameter of the waste package.
9. Demonstrate the retrieval tool using a mock-up with plexiglass tube and three or four stacked packages/cans, on the Mark II version to validate that the retrieval tool does not interfere with the waste package beneath the one being retrieved.

Later it was determined that the safety bars should be in a deployed (i.e. closed) position while the retrieval tool is travelling down through the tile hole to the waste package, to keep the triangular fingers from catching on the sides of the tile hole wall. This improved the operability of the system.

Thus, the following list of design inputs was developed:

TABLE 1

List of Design Inputs for Mark II retrieval tool

| # | DESCRIPTION |
|---|---|
| 1 | Weight of packages: 5 to 50 kg |
| 2 | Air pressure delivery system operation <15 psig and be protected by a PSV (pressure safety valve) to <15 psig |
| 3 | Volume of air in pressurized system to be less than 1.5 $ft^3$ |
| 4 | Verification to be carried out on a tile hole |
| 5 | Equivalent diameter of air wedges to be <6.5 inch diameter |
| 6 | Equipment shall permit the retrieval of nine waste packages from a tile hole without having to reconfigure the retrieval tool |
| 7 | A mechanical back-up system (safety bars) to be in place to provide support to a package if the air wedges cannot provide sufficient friction to hold the waste package being retrieved |
| 8 | Appropriate markings to be added to the equipment to show vertical and radial positions of safety bars |
| 9 | Air wedges are to be retracted as far as possible to maximize clearance to packages prior to retrieval |
| 10 | Easy to use tools (e.g. handle to wind in wire, wrench to move one feature relative to another) to be employed to activate the equipment during operation |
| 11 | Equipment to be designed to be able to retrieve waste packages that are close to, or are touching the tile hole wall |
| 12 | Lifting equipment to follow ASME B30.20-2010 Category A Service Class 0 |

TABLE 1-continued

List of Design Inputs for Mark II retrieval tool

| # | DESCRIPTION |
|---|---|
| 13 | Equipment to be designed to lift packages from tile holes without snagging |
| 14 | Incorporate a mechanical stop to ensure that the equipment cannot go beyond the depth of the waste package being retrieved |
| 15 | Equipment to ensure only one waste package can be retrieved at one time |
| 16 | The equipment is to accommodate the worst case geometries of the tile hole and packages as per the requirements provided below: |
| 17 | Waste container material: plastic and metal |
| 18 | Waste package height: 15 to 18 inches |
| 19 | Waste package outside maximum diameter: 10 to 13 inches |
| 20 | Tile hole diameter: 14.775/15.225 inches (based on ASTM A-76) |
| 21 | Tile hole depth: Nominally 15 feet 11 inches |
| 22 | Provide means to cut and remove leader wires attached to waste packages without damage to waste packages |
| 23 | Operation of equipment should be designed to keep operators away from the tile hole opening |
| 24 | Equipment to include a camera or cameras to enable visual monitoring inside the tile hole |
| 25 | Tool to be retrievable from tile hole in the event of a failure |

These issues were addressed in developing the embodiment described herein.

Design Details

This section describes the proof of concept retrieval tool features and its principal of operation.

Figure 2:
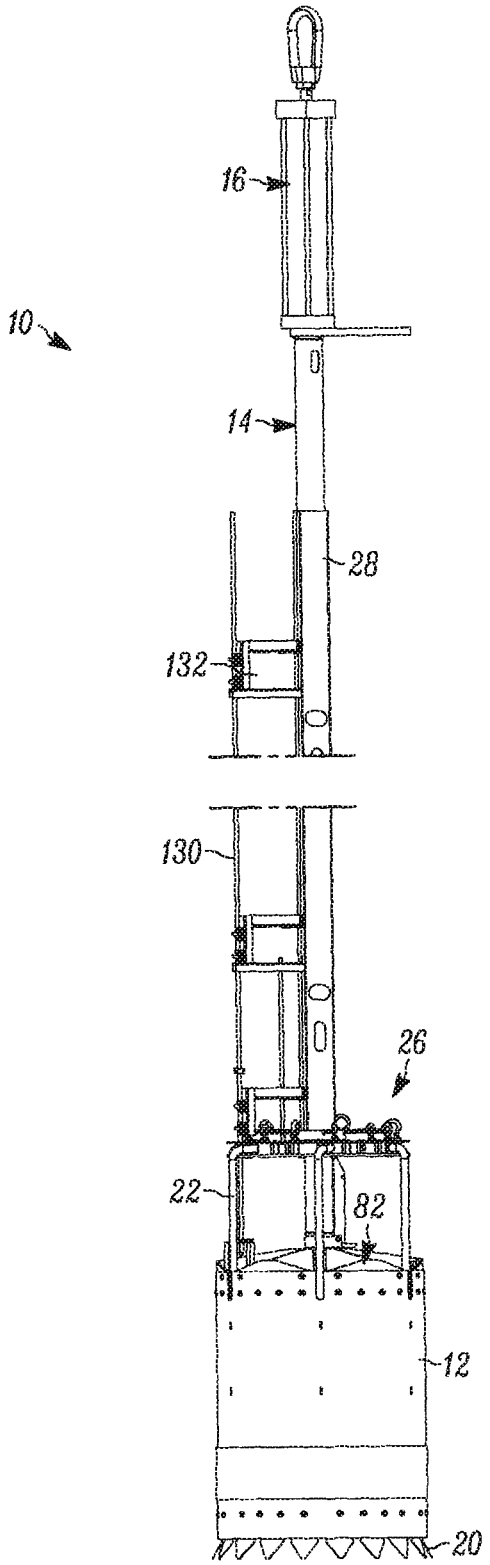
FIG. 2 shows a retrieval tool system suspended from a lifting tube and load limiter.
Figure 3:
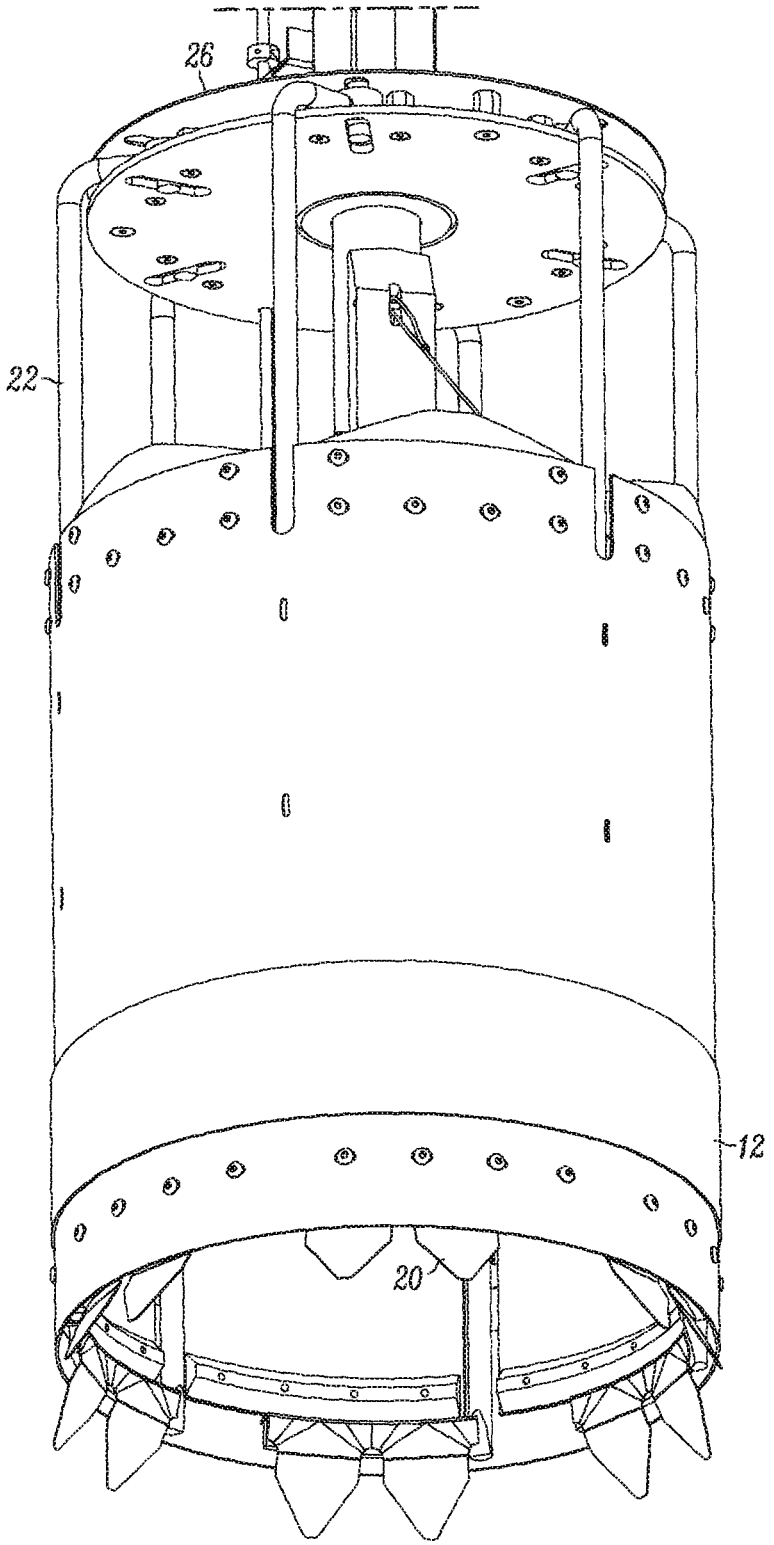
FIG. 3 shows a photograph of the lower end of the retrieval tool.

The general assembly of the retrieval tool 10 can be seen in FIGS. 2 and 3. The stainless steel lower cylinder 12 is suspended from a round lift tube 14. The round lift tube 14 in turn, is suspended from a crane, backhoe or similar lowering machine, via a load limiter 16 (i.e. a spring loaded shock absorber), which keeps the entire weight of the retrieval tool 10 and lowering machine from bearing on the waste package being removed. The height of the retrieval tool 10 is dictated by the depth of the tile hole. The prototype retrieval tool 10 is over 19 feet long and has been designed to remove one waste package at a time from an Irradiated Rod Part (IRP) tile hole with up to nine waste packages stored inside. The stainless steel lower cylinder 12 contains six equally spaced inflatable air wedges 18 (see FIGS. 4 and 5). The triangular shaped metal fingers 20 can be seen in FIG. 2, and in the photo of the lower part of the retrieval tool 10 in FIG. 3. These triangular shaped metal fingers 20 are designed to centre the retrieval tool 10 within the tile hole and to encourage waste packages that are leaning against the side of the tile hole into the aperture of the retrieval tool 10.

Figure 6:
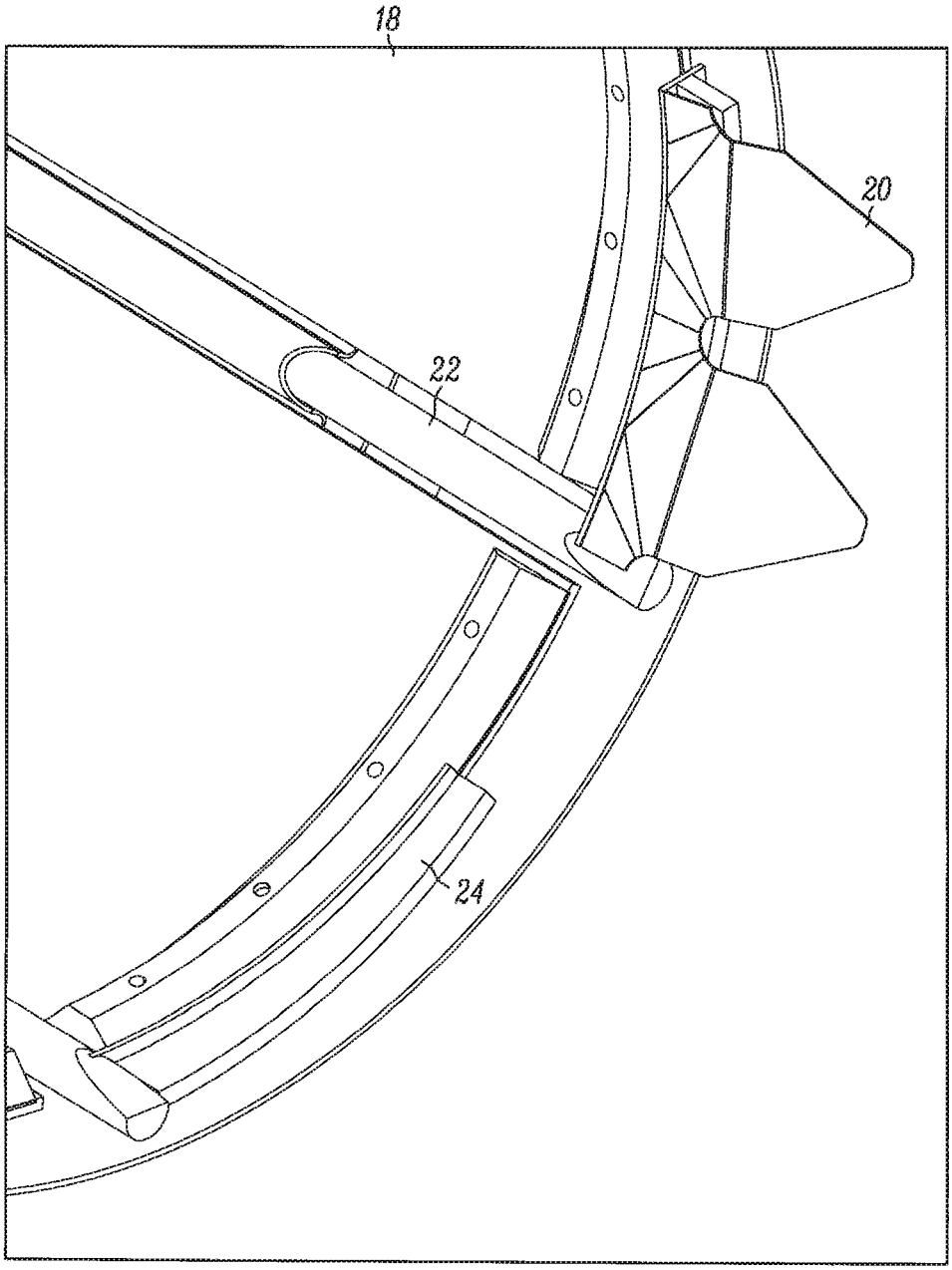
FIG. 6 shows a detail of the air wedges clamped in the body of the retrieval tool.
Figure 7:
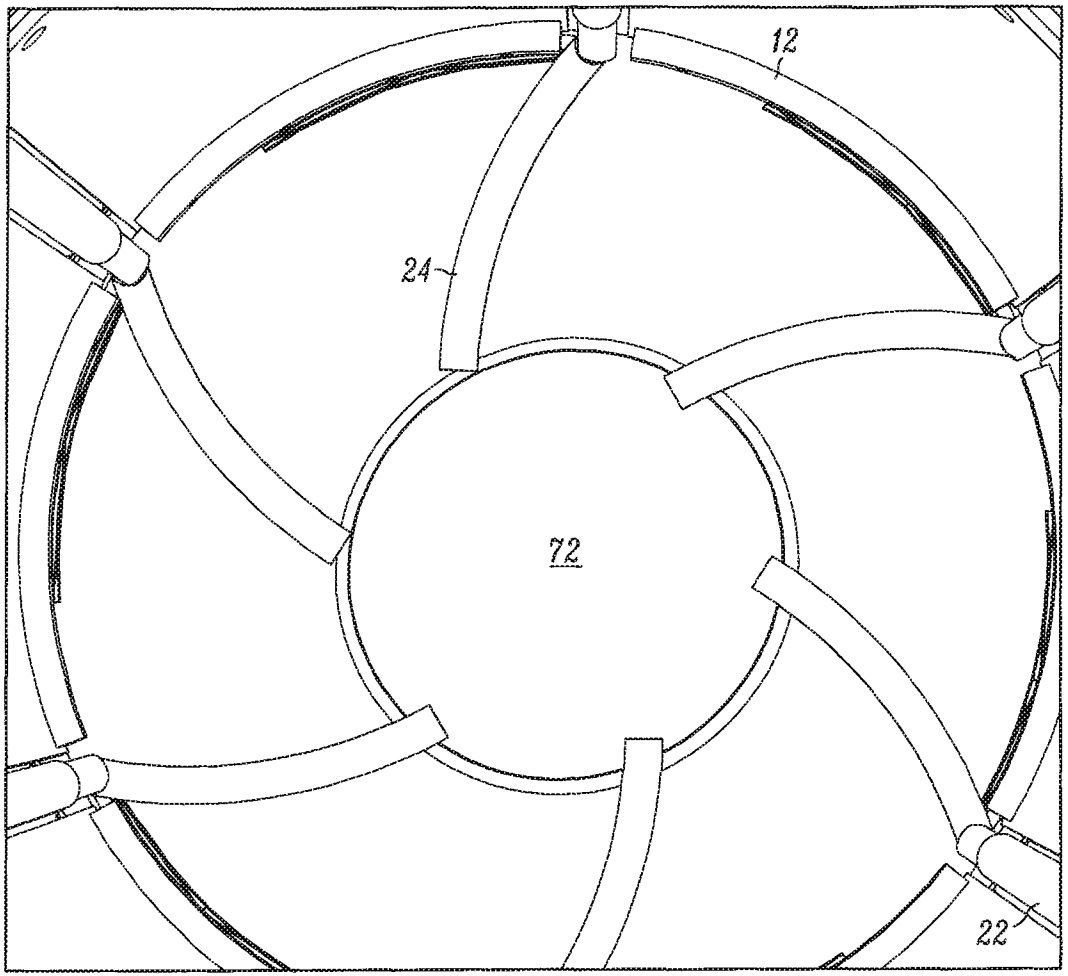
FIG. 7 presents a screen capture of the top of a package in a tile hole array, as viewed from the retrieval tool's camera.

A back-up feature is the use of a partial platform that can be positioned below the waste package being retrieved. Providing such a platform presented a design challenge since the partial platform had to allow the waste package to pass through it and into the stainless steel cylinder 12 as the retrieval tool 10 is being lowered. This requirement was met by using six rotatable "safety bars" 22. The lower part of each safety bar has a 90° horizontal arm 24 welded to it. The safety bar horizontal arms 24 are arcuately-shaped so that when retracted (in the "open" position) the safety bar horizontal arms 24 align with the leading peripheral edge of the stainless-steel cylinder 12, allowing the waste package to enter the retrieval tool 10. FIG. 6 presents one of the safety bar horizontal arms 24 with the triangular shaped metal fingers 20 removed so that it can be clearly seen. FIG. 7 presents a view of the safety bar horizontal arms 24 in a deployed (i.e. "closed" position), although the safety bar horizontal arms 24 are actually above the waste container in this view.

The safety bars 22 are connected to a disc assembly 26 (a cam) that is located above the stainless steel cylinder 12. This disc assembly 26 is connected to a square hollow tube 28 that extends to the top of the retrieval tool 10. Inside the square tube 28 is the round lift tube 14 that connects to the stainless steel cylinder 12 and also to the top of the retrieval tool 10. It is the round lift tube 14 which bears the load of the system. The round lift tube 14 and square tube 28 can rotate relative to each other. When the square tube 28 is rotated, it turns the disc assembly 26 with respect to the stainless steel lower cylinder 12. This in turn rotates the safety bar arms 24 towards the centre of the stainless steel cylinder 12 providing a platform in case the waste package or parts of the waste package fall from the inside of the retrieval tool 10. Inside the round lift tube 14 are the pneumatic lines 30 connecting the inflatable air wedges 18 to compressor and vacuum system 32, and also wires connecting a video camera with integral LED lighting 34, and a radiation detector 36. The electronic data for radiation detection and camera footage is captured on a laptop computer, tablet computer or similar device.

Figure 8:
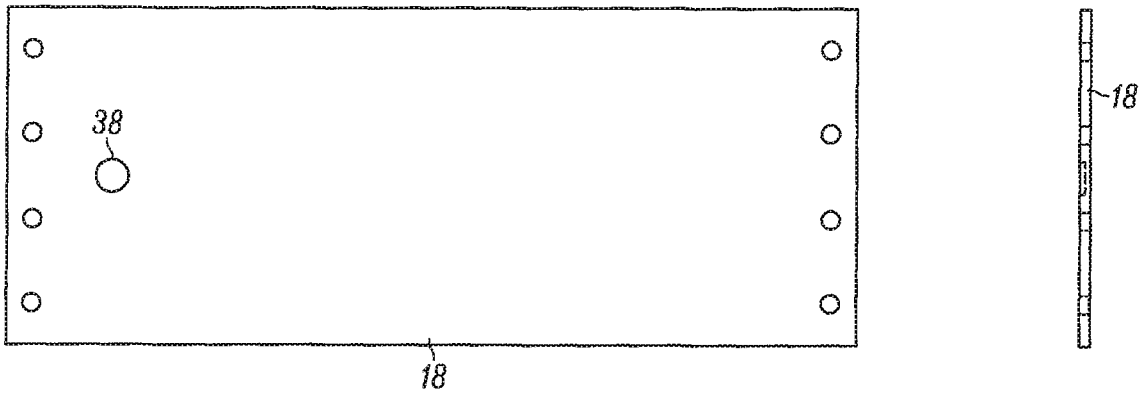
FIG. 8 shows a drawing of the air wedges themselves.

Referring to FIG. 8, the six inflatable air wedges 18 are constructed from a commercially available lay-flat hose (similar to a fire hose) that is clamped shut at both ends by bolting the lay-flat hose to the stainless steel lower cylinder 12 of the retrieval tool 10. A hole 38 near one end of each section of hose allows the inflatable air wedges 18 to be connected to a plastic tube by means of a through-wall fitting and tube connector 40. In this particular case, the lay-flat hose is a 4" nominal size PVC covered polyester yarn reinforced 75 psi rated water hose, purchased from McMaster-Carr (item No. 5295K41), chosen since it had the right balance of flexibility, puncture resistance, friction and lay-flat width. Other hoses can be considered depending on the application. The through-wall fitting 40 was also purchased from McMaster-Carr (item No. 8682T21), and was installed in the hose wall. All six inflatable air wedges 18 were connected to the compressor and vacuum system by means of the distribution header 42 shown in FIGS. 4, 5 and 11, and ¼" 'Polyflo' tubing.

Figure 4:
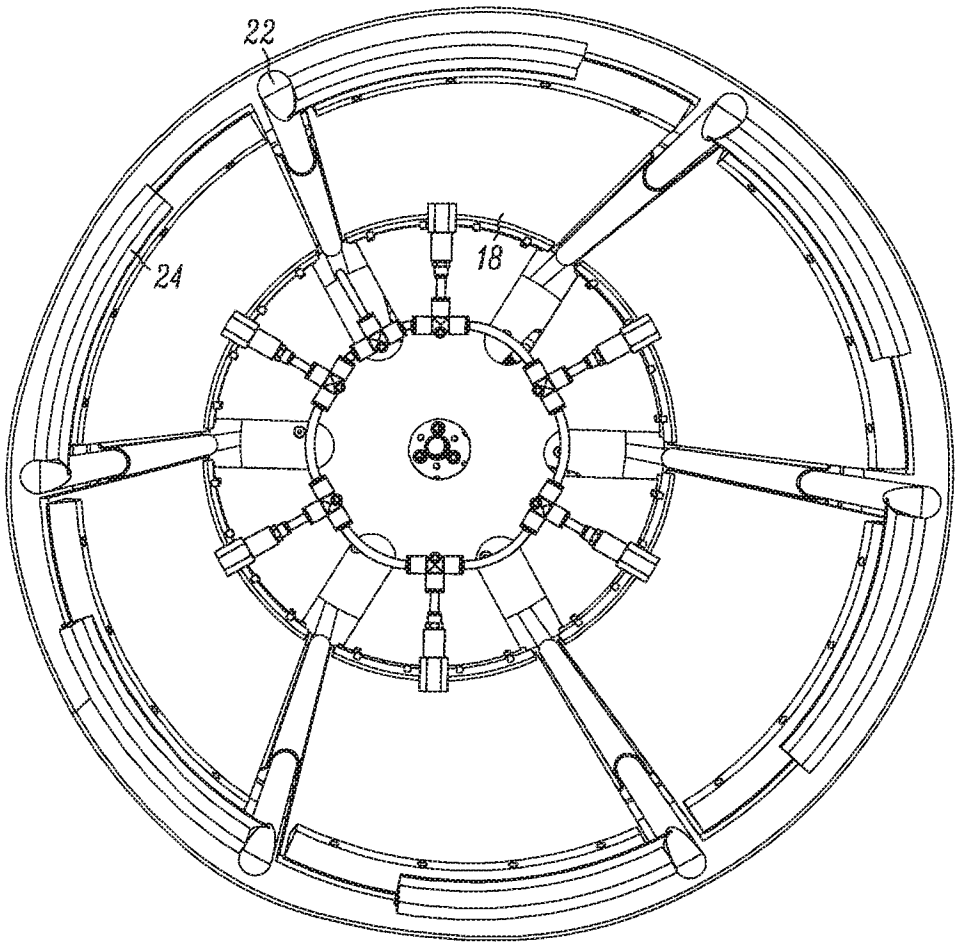
Figure 5:
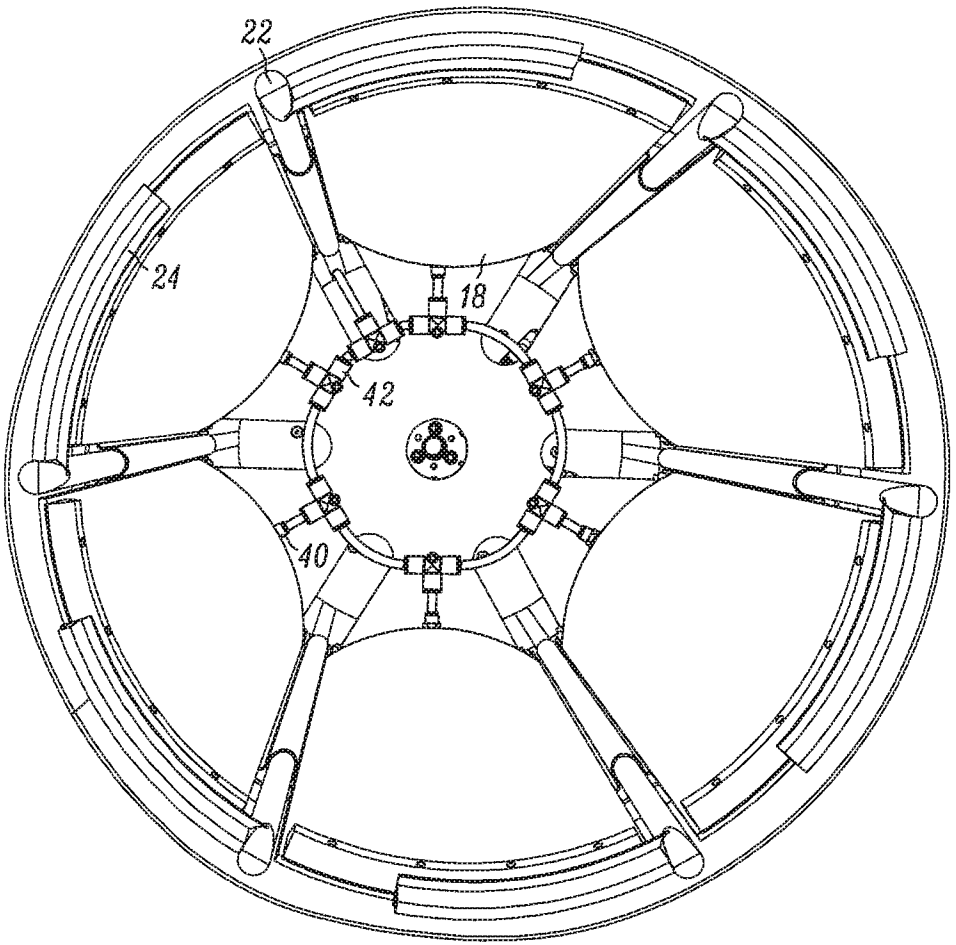
FIG. 5 shows the air wedges partially inflated.
Figure 9:
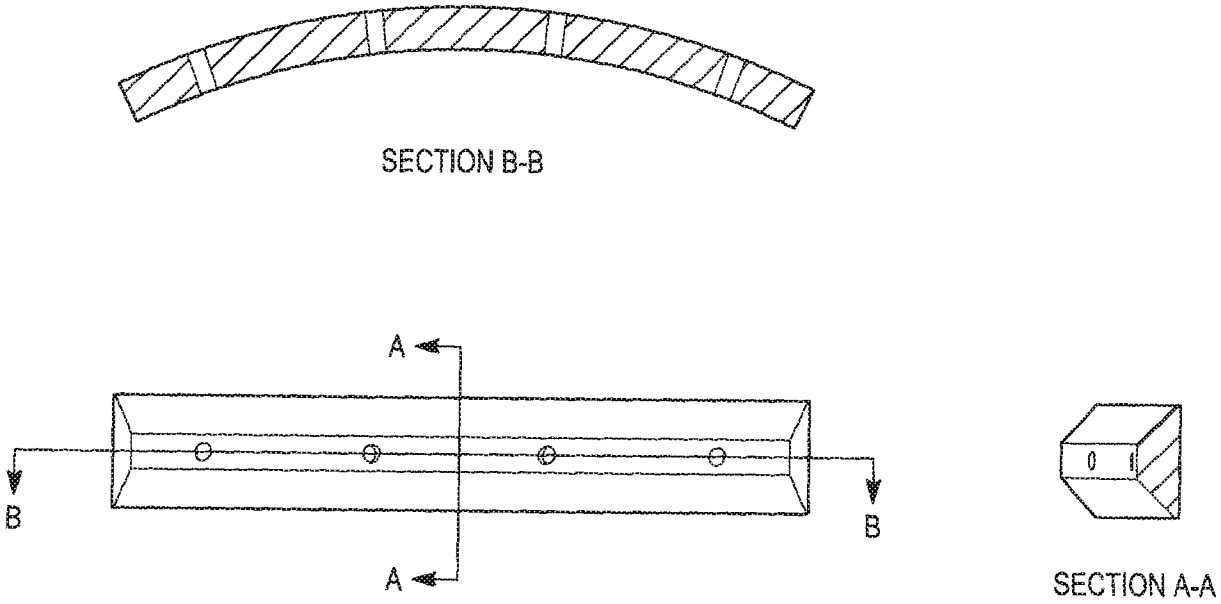
FIGS. 9 and 10 show details of the air wedge clamp.
Figure 10:
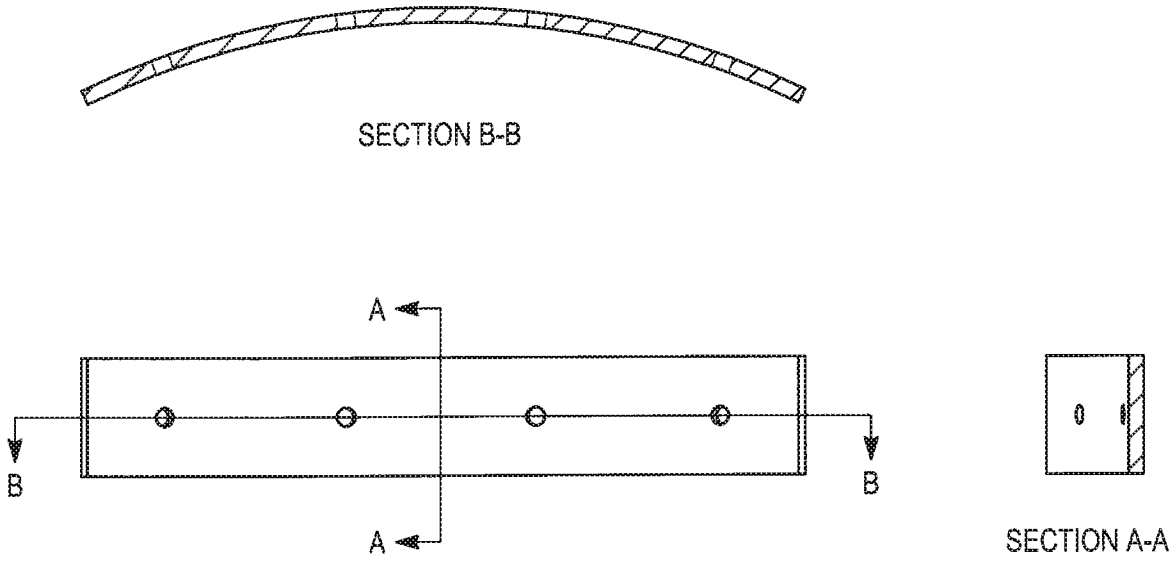

FIG. 6 shows a close-up view of the inflatable air wedges 18 clamped to the stainless steel lower cylinder 12 of the Mark I version of the retrieval tool 10. FIG. 4 shows the six inflatable air wedges 18 in a deflated state. Also visible is the distribution header 42, comprising tube tees, adapters and through-wall fittings 40. FIG. 5 shows the inflatable air wedges 18 partially inflated, again in the Mark I version of the retrieval tool 10. FIGS. 9 and 10 show the clamp details for the inflatable air wedges 18, while FIG. 11 shows a schematic diagram of the pressure/vacuum supply, all of which are for the Mark II version of the retrieval tool 10.

As shown in FIG. 8, each of the inflatable air wedges 18 comprises a length of 4" PVC covered polyester yarn lay-flat water hose. Each length of hose is clamped at the top and bottom of the stainless steel cylinder with a pair of clamps as shown in FIGS. 9 and 10, the clamp of FIG. 9 being placed on the inside of the stainless steel cylinder 12, and the clamp of FIG. 10 being placed on the outside. The inside clamp of FIG. 9 is fabricated from austenitic, annealed stainless steel, UNS S30400/S30403 (AISI 304/304L). The outside clamp of FIG. 10 is fabricated from type 304L stainless steel, 11 gauge, 2B finish, per ASTM A240. These inside and outside clamps are bolted together using stainless steel bolts, though other fasteners could also be used such as rivets. As the inflatable air wedges 18 are inflated and deflated, their length will change to a small degree. To accommodate this, the stainless steel cylinder 12 is actually fabricated from two co-axial cylinders, in a sliding sleeve arrangement. There is no need for springs or other mechanisms to bias the two cylinders relative to one another; they can slide freely as their positions will be determined by the length of the inflatable air wedges 18, and the extent to which the inflatable air wedges 18 are inflated.

Figure 11:
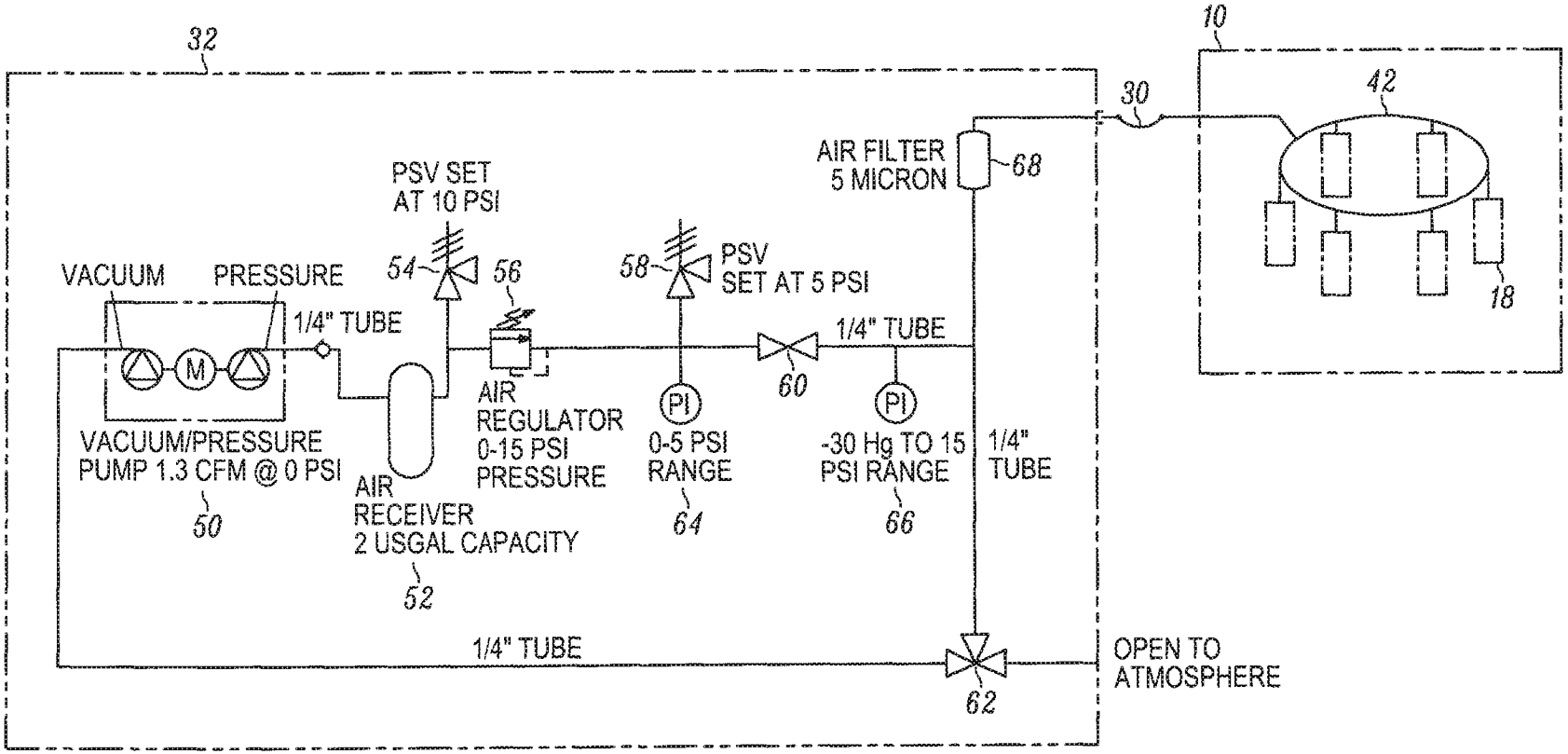
FIG. 11 shows a schematic diagram for the compressor and vacuum supply system.

As shown in the schematic diagram of FIG. 11, the compressor and vacuum system 32 consists primarily of a 1.3 CFM vacuum/pressure pump 50 and a 2 U.S. gallon air receiver 52. The compressor and vacuum system 32 is protected with a 10 PSI pressure safety valve 54 upstream of an adjustable air regulator 56, and a 5 PSI pressure safety valve 58 on the downstream side. As well be explained in greater detail hereinafter, the operating pressure of the prototype system was 2.1 psig. The two-way valve 60 is used to control the delivery of air pressure to the inflatable air wedges 18. The three-way control valve 62 is used to control the vacuum to collapse the inflatable air wedges 18. The compressor and vacuum system 32 is provided with visual pressure displays 64, 66 on the upstream and downstream of the two-way control valve 60, and a 5 micron air filter 68. All of the pneumatic tubing is ¼" Polyflo tubing. While this is a manual system, it could easily be automated and operated with a commercial tablet or laptop computer, or a dedicated electronic control system.

The general arrangement of the latest version of the retrieval tool 10 and major sub-assemblies are shown in FIGS. 12A to 19. The details of how the locking mechanism works on the safety bar horizontal arms 24 is shown in FIGS. 14 to 18. As much as possible, the retrieval tool was built from stainless steel, aluminum and other corrosion resistant materials to allow the retrieval tool to be exposed to outdoor weather conditions.

Figure 12A:
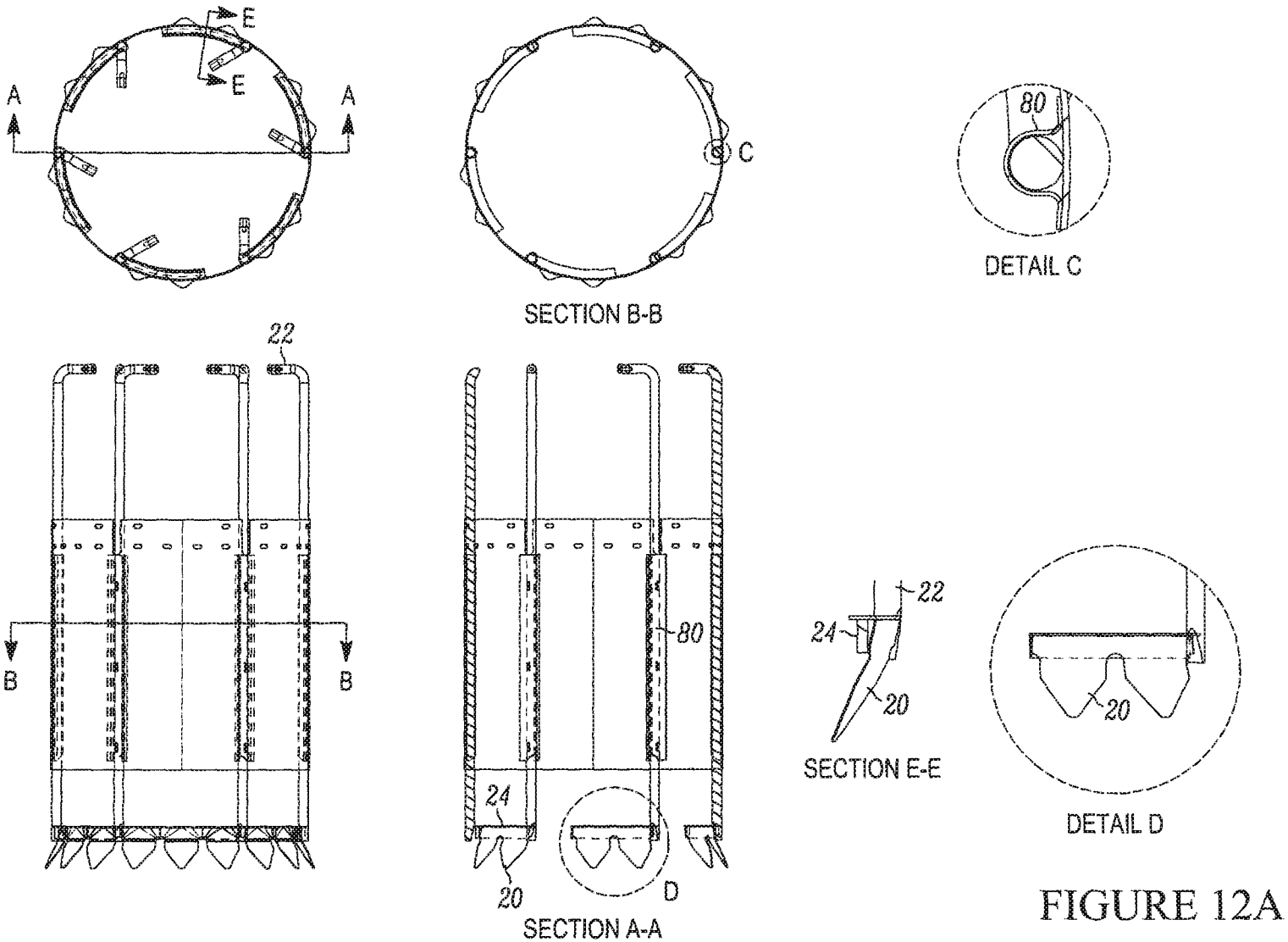
FIG. 12A shows the body weldment of the retrieval tool, FIGS. 12B and 12C showing the rotatable safety bars in lowered and raised positions respectively.
Figure 12C:
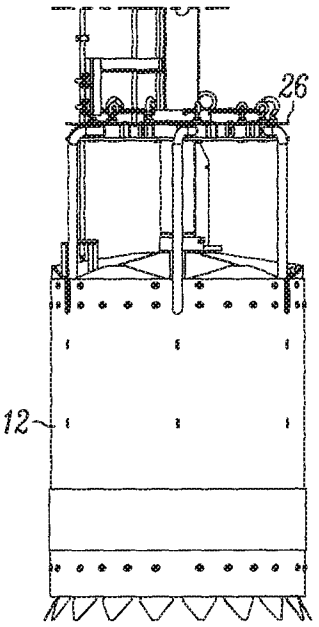
Figure 12B:
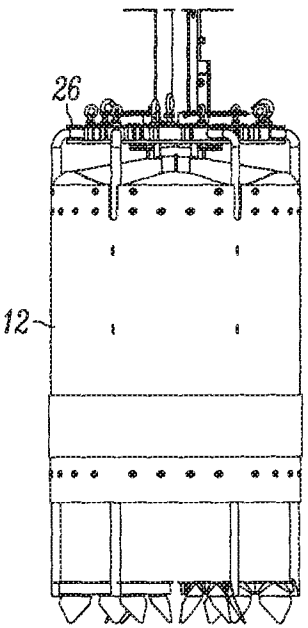
Figure 13:
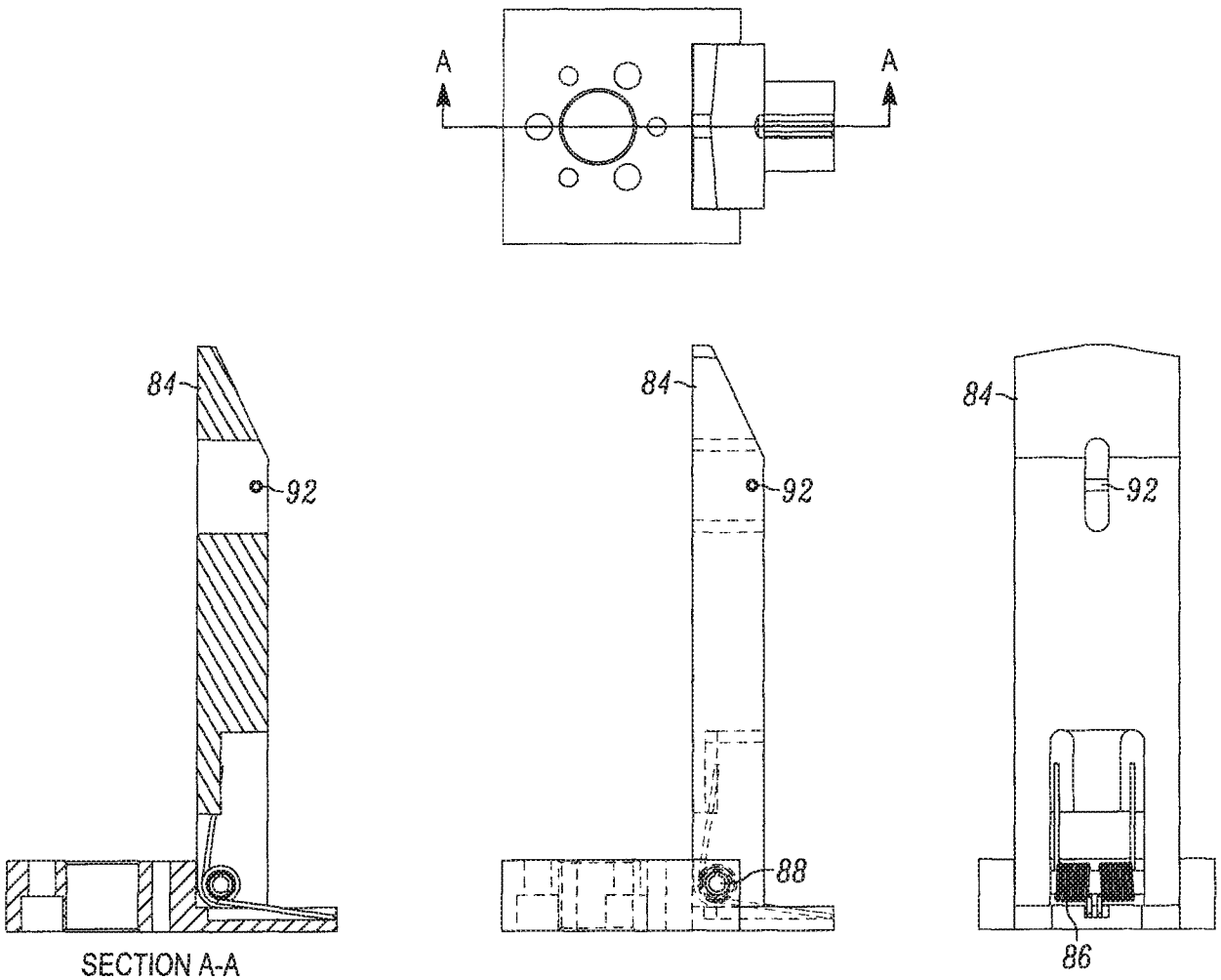
FIG. 13 shows details of the vertical latch subassembly of the retrieval tool.

As shown in FIG. 12A, the six rotatable safety bars 22 are mounted to the stainless steel cylinder 12 with stainless steel guides 80 which are tack-welded to the stainless steel cylinder 12. The six rotatable safety bars 22 are equally-spaced about the circumference of the stainless steel cylinder 12, are free to rotate within the stainless steel guides 80, and can move a certain distance longitudinally. This longitudinal movement allows the safety bar horizontal arms 24 to drop down below the bottom of the stainless steel cylinder 12 before being rotated inwardly, avoiding a waste package that may be protruding slightly below the bottom of the stainless steel cylinder 12. The rotatable safety bars 22 are shown in their lower position in FIG. 12B and in their upper position in FIG. 12C. The triangular metal fingers 20 at the bottom of the retrieval tool 10 are welded to the safety bar horizontal arms 24 as shown in photograph of FIG. 12A. The waste packages invariably lean to one side against the wall of the tile hole. The triangular metal fingers 20 urge the waste package away from the tile hole wall to allow gripping of the waste package.

The six rotatable safety bars 22 pass through the lift tube spider 82 welded to the top of the stainless steel cylinder 12, the upper ends of the rotatable safety bars 22 being connected to the actuator disk 26. As noted above, the actuator disk 26 can move between an upper position in which the safety bar horizontal arms 24 are recessed within the stainless steel cylinder 12, and a lower position in which the safety bar horizontal arms 24 drop below the bottom of the stainless steel cylinder 12. The actuator disk 26 is held in the upper position by means of the latch 84 shown in FIG. 13. The latch 84 pivots between two positions—the raised position in which it holds up the actuator disk 26 per FIG. 16, and a lowered position in which the actuator disk 26 drops under the force of gravity, allowing the safety bar arms 24 to drop down below the bottom of the stainless steel cylinder 12. The latch 84 is urged to the raised position by a spring 86, pivoting around latch pin 88. A wire latch release cable 90 is connected to the upper part of the latch 84 with a small pin 92, the latch release cable 90 being used to release the latch 84 when the actuator disk 26 is rotated. The other end of the latch release cable 90 is connected to a rod clamp and tubing 92 (¼" OD×0.035 wall thickness seamless stainless steel ASTM a269 type 304) mounted on the lift tube spider 82 (see FIG. 14).

Figure 14:
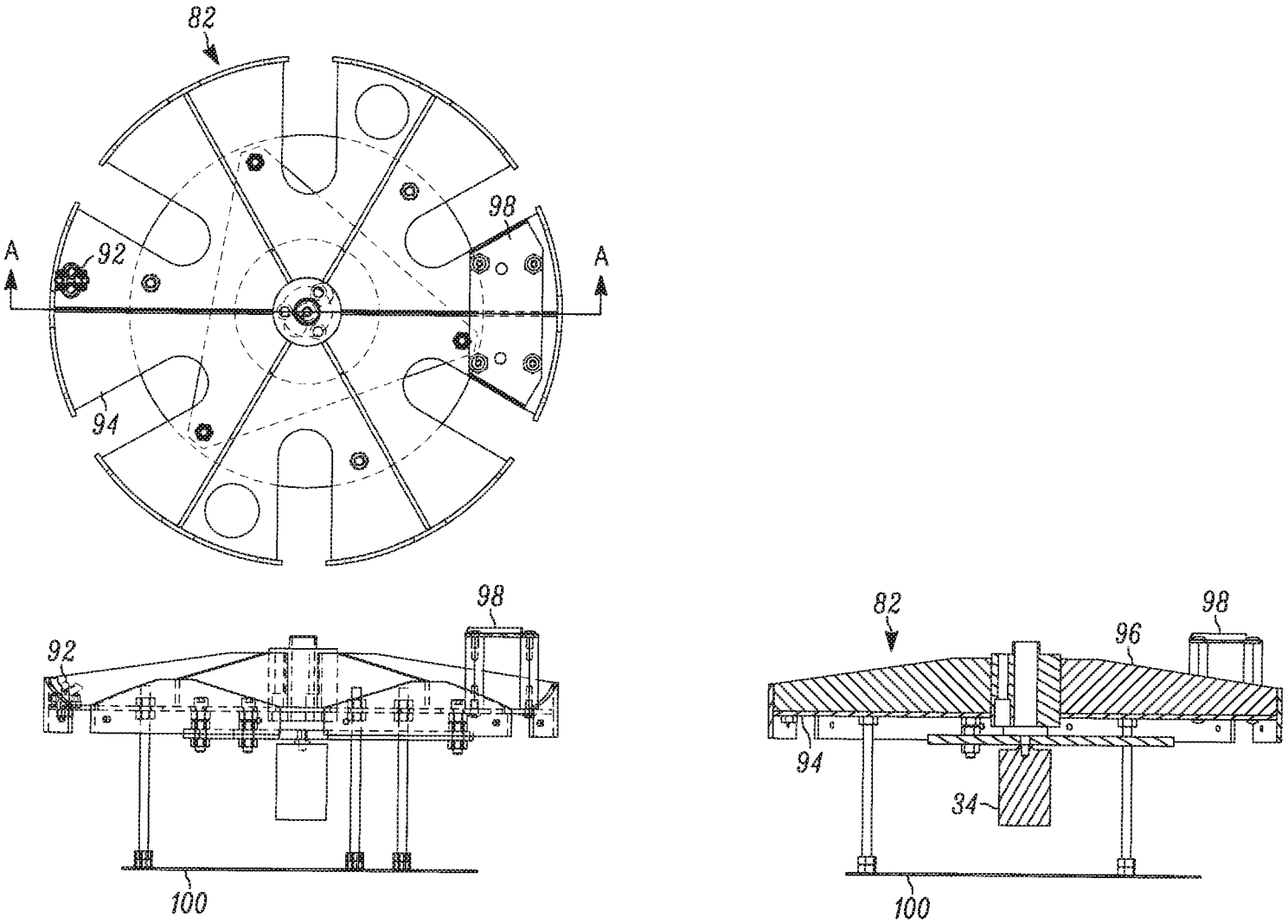
FIG. 14 shows details of the lift tube spider subassembly of the retrieval tool.

As shown in FIG. 14, the lift tube spider 82 is a circular stainless steel plate 94 with strengthening webs 96, which is welded to the top of the stainless steel cylinder 12 to give it strength. The lift tube spider 82 serves as a bearing surface for the actuator disk 26 when it drops, and also serves as a support surface for the lock plate 98, the stop plate 100 and the video camera 34. Slots are cut into the lift tube spider 82 so that it will not interfere with the rotatable safety bars 22.

The lock plate 98 is a stainless steel plate with two holes through which the lock bar 102 may be inserted. This allows the rotational position of the actuator disk 26 to be fixed in one of two positions. This in turn, fixes the safety bar horizontal arms 24 in either the stowed or deployed position. The lock plate 98 is mounted to the lift tube spider 82 with threaded hex standoffs (2" long×10-32 UNF threads, 18-8 stainless steel McMaster-Carr p/n 91115a417 or equal, and 10-32 UNF×⅜" long socket button head cap screws, to meet ANSI b18.3 and ASTM f835).

The stop plate 100 is a stainless steel plate which rests on the top of the waste package after the retrieval tool 10 is lowered into position. The stop plate 100 is mounted to the lift tube spider 82 with ¼-20 UNC×5" long threaded stud, 18-8 stainless steel, McMaster-Carr p/n 95412a562 or equal, and ¼-20 UNC hex nuts, 18-8 stainless steel, to AISI b18.22 and ASTM f594.

The camera mounting plate 102 is a stainless steel plate which is mounted to the lift tube spider 82, again, with threaded rod and hex nuts. Any suitable video camera 34 may be used, but in the prototype, Micro Video Products model number mvc2000wp-led, was used, with a 100' cable and the focus distance set at 17". A computer tablet may be used to operate this fixed focus camera. The camera was set up to give the clearest picture from the tip of the safety bars. It was used as a reference to ensure that the waste package was not slipping in the retrieval tool by observing any changes in the image. No slippage was observed in any of the retrievals.

Figure 15:
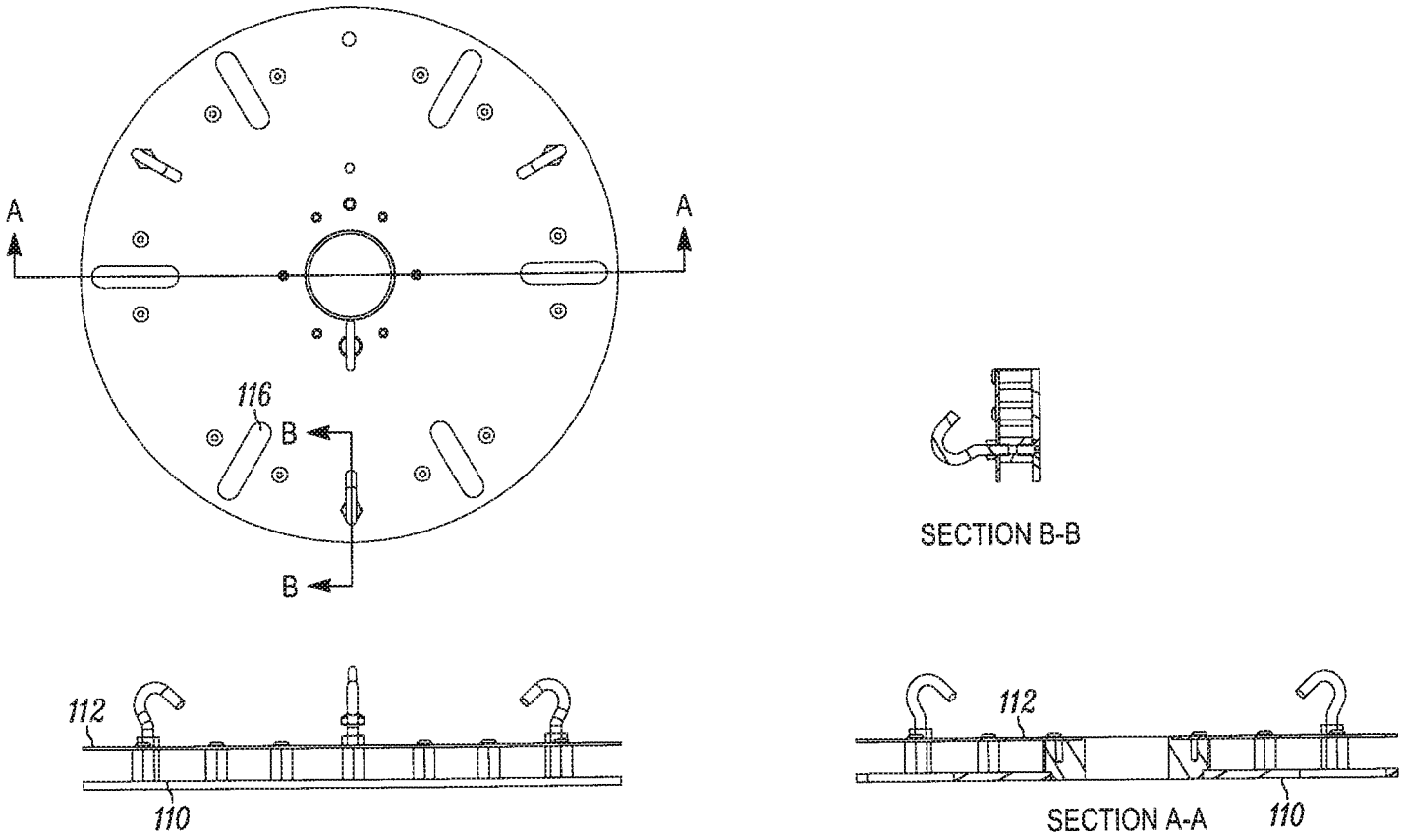
FIG. 15 shows details of the actuator disk subassembly of the retrieval tool.

The details of the actuator disk 26 construction are shown in FIG. 15. The actuator disk lower assembly 110 and actuator disk upper plate 112 are connected with threaded hex standoffs (¾" long×10-32 UNF threads, 18-8 stainless steel McMaster-Carr p/n 91115a407 or equal) and button head cap screws on the top (10-32 UNF×⅜" long socket button head cap screw, to meet ANSI b18.3 and ASTM f835 or equal), with flat head cap screws on the bottom (10-32 UNF×½" long socket flat head cap screw, to meet ANSI b18.3 and ASTM f835 or equal).

Figure 16:
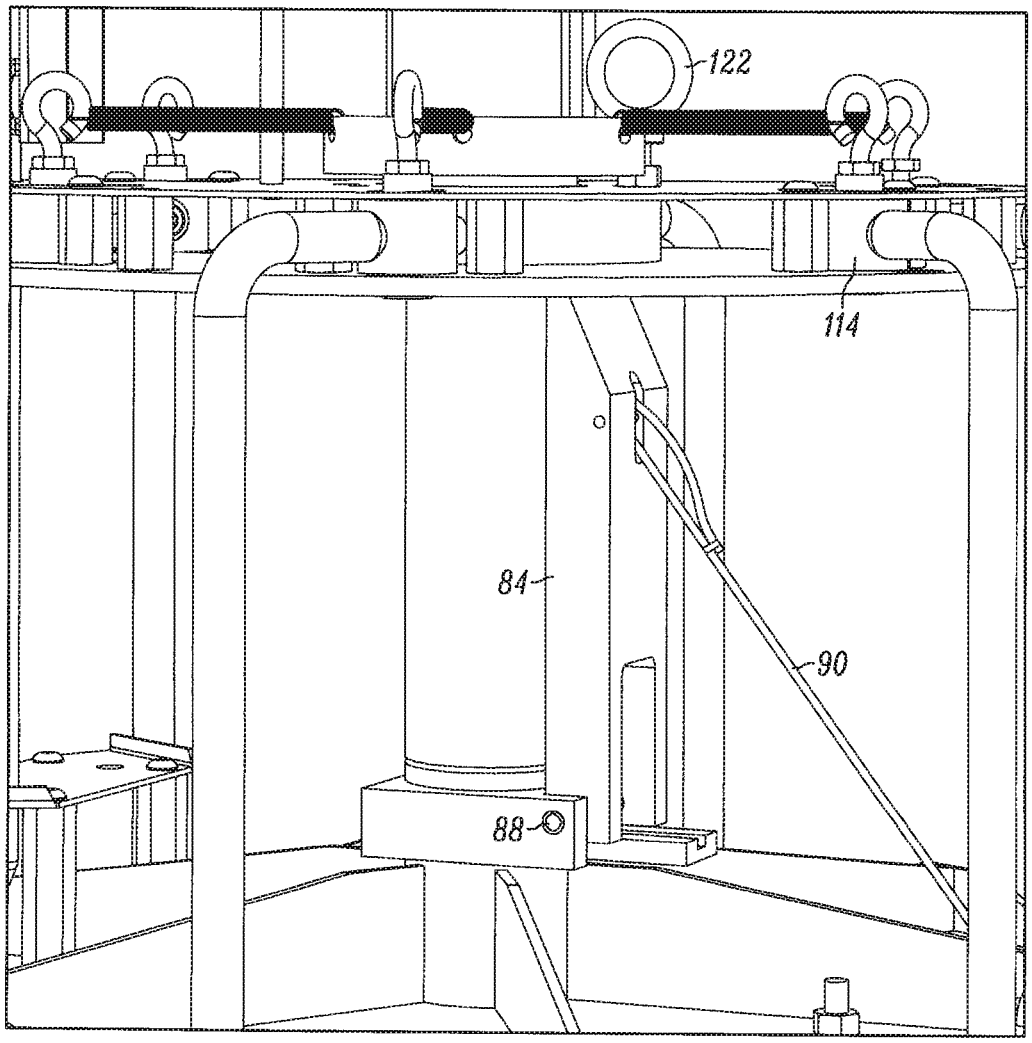
FIG. 16 shows a detail of the latch mechanism of the retrieval tool, including the latch release cable.
Figure 17:
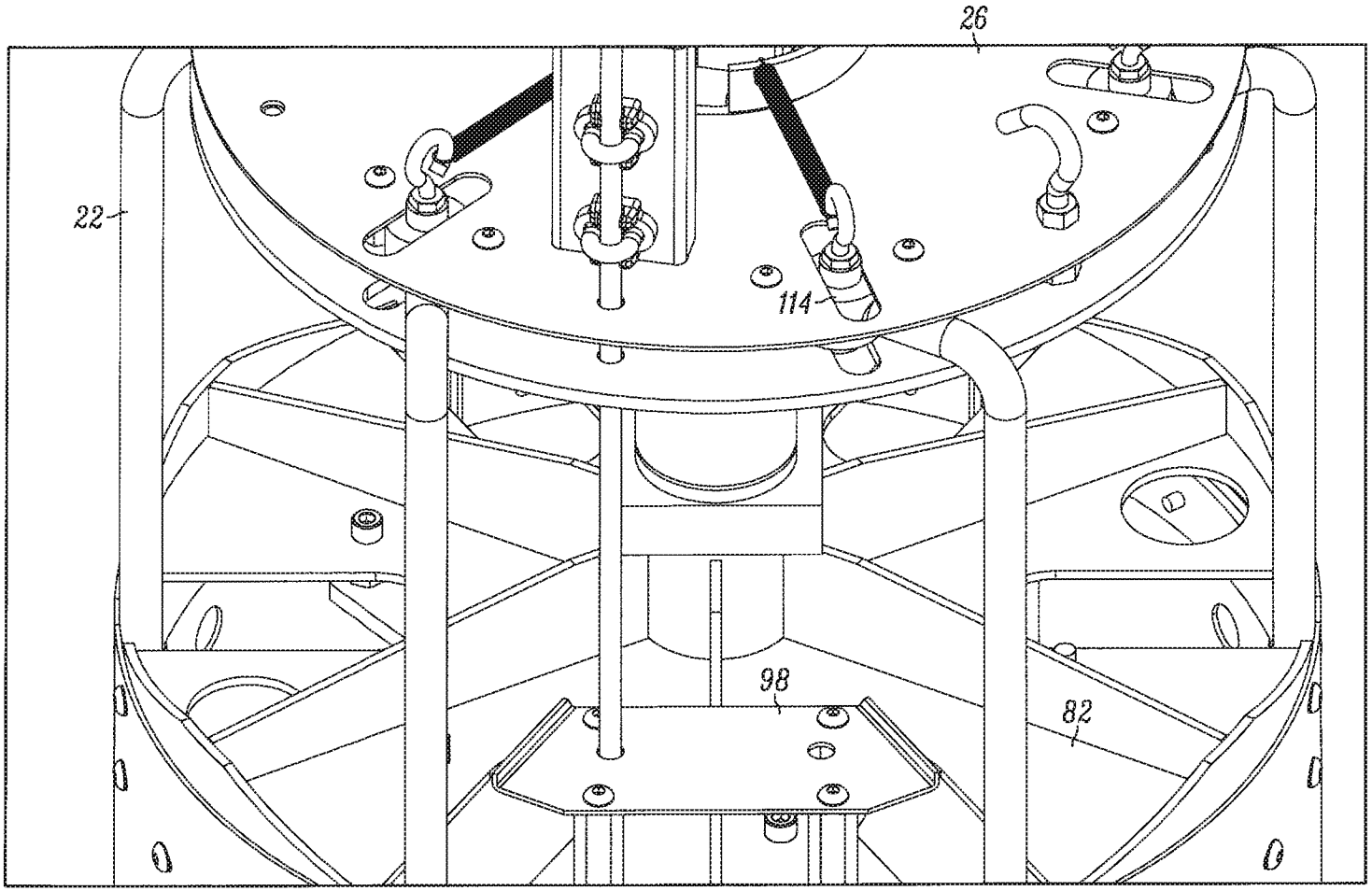
FIG. 17 shows a detailed view of the top of the retrieval tool where the radial position locking mechanism is visible.

As shown in FIGS. 16 and 17, the top end of each safety bar terminates at a fitting 114 that slides within grooves 116 in the actuator disk lower assembly 110 and actuator disk upper plate 112. Thus, when the actuator disk 26 is rotated with respect to the stainless-steel cylinder 12, the fittings 114 slide within the grooves 116, causing the rotatable safety bars 22 to rotate. Also as shown in FIGS. 15, 16, 17 and 18, each fitting 114 has a steel j-hook 118 (¼-20 UNC thread, McMaster-Carr p/n 9492t13 or equal cut threads to ½" long, or equal), which holds a spring 120 connected to a hub at the center of the actuator disk assembly 26. This spring biases the fitting 114 towards the center of the actuator disk assembly 26, and biases the safety bar horizontal arms 24 to the deployed position.

The actuator disk assembly also includes a steel eyebolt 122 with a shoulder for lifting the assembly (¼"-20 thread, 500 lb working load min 1"-thread length).

The main square tube 28 is fabricated from stainless steel sheet, type 304L, 20 ga, 2b finish, material per ASTM a240. It has a number of brackets 132 welded along its length to guide the lock rod 130. Each lock rod lift bracket 132 has a pair of rod clamps to guide the lock rod 130. One or more clamp-on stainless steel shaft collars (¼" two-piece clamp-on stainless steel shaft collar McMaster-Carr p/n 6436k32 or equal) may be fastened to the lock rod 130 to limit its range of longitudinal movement within the guides.

Thus, the lock rod 130 slides vertically through holes in the actuator disk assembly 26 shown in FIG. 15, and drops into one of two holes in the lock plate 98 of FIGS. 14 and 17. With this arrangement, the actuator disk 26 can be rotated into one of two discrete positions, with the cams in the actuator disk 26 opening and closing the safety bars 22. The actuator disk 26 rests on the vertical latch 84 shown in FIG. 16 to maintain the safety bars 22 in the upper position. Once the waste package is raised slightly, a tug on a wire latch cable 90 trips the latch 84 which allows the safety bars 22 drop the height of the latch 84.

Figure 19:
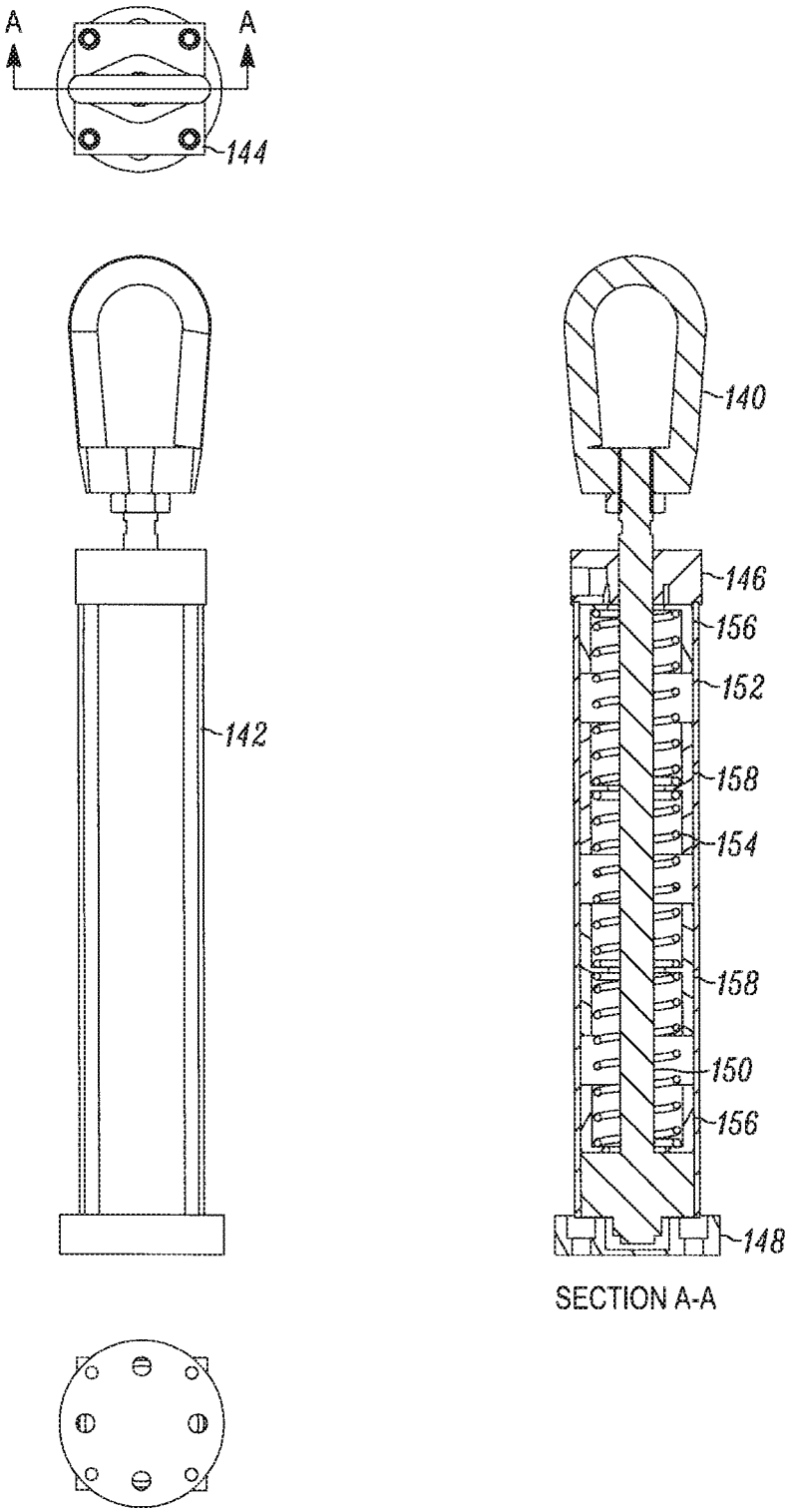
FIG. 19 shows a detail of the load limiter subassembly of the retrieval tool.

A detail of the load limiter assembly 16 is shown in FIG. 19. The eyenut 140 would typically be chosen to accommodate whatever lifting machine is to be used, and the weight of the retrieval tool 10. In this case a ¾"-10 UNC eyenut, plain steel galvanized, 5,200 work load limit, McMaster-Carr p/n 3019t21 was used. The eyenut 140 is locked using a ¾-10 UNC hex jamnut, zinc plated, SAE grade 5.

In this assembly four pneumatic cylinder tie rods 142 (forming part of Motions Controls LLC 2½" bore×12" stroke cylinder, p/n d49senc s112 ra1 or equal) and pneumatic cylinder tie rod nuts 144 (forming part of Motions Controls LLC 2½" bore×12" stroke cylinder, p/n d49senc s112 ra1 or equal) fasten together the upper end cap 146 and lower end cap 148 (pneumatic cylinder end cap assembly, Motions Controls LLC 2½" bore×12" stroke cylinder, p/n d49senc s112 ra1 or equal).

A pneumatic cylinder piston and rod assembly 150 (forming part of Motions Controls LLC 2½" bore×12" stroke cylinder, p/n d49senc s112 ra1 or equal) is housed within a pneumatic cylinder barrel 152 (forming part of Motions Controls LLC 2½" bore×12" stroke cylinder, p/n d49senc s112 ra1 or equal). The pneumatic cylinder barrel 152 also houses three standard music wire compression springs 154 (1.937 OD×4.5" free length 89.2 lb force at 2.788" compressed height, k=52.1 lb/ln, Associated Spring Raymond p/n c1937-192-4500-m), which are seated against load limiter end spring cups 156 at the upper and lower end, and are divided by two load limiter center spring cups 158 within the pneumatic cylinder barrel 152.

Figure 20:
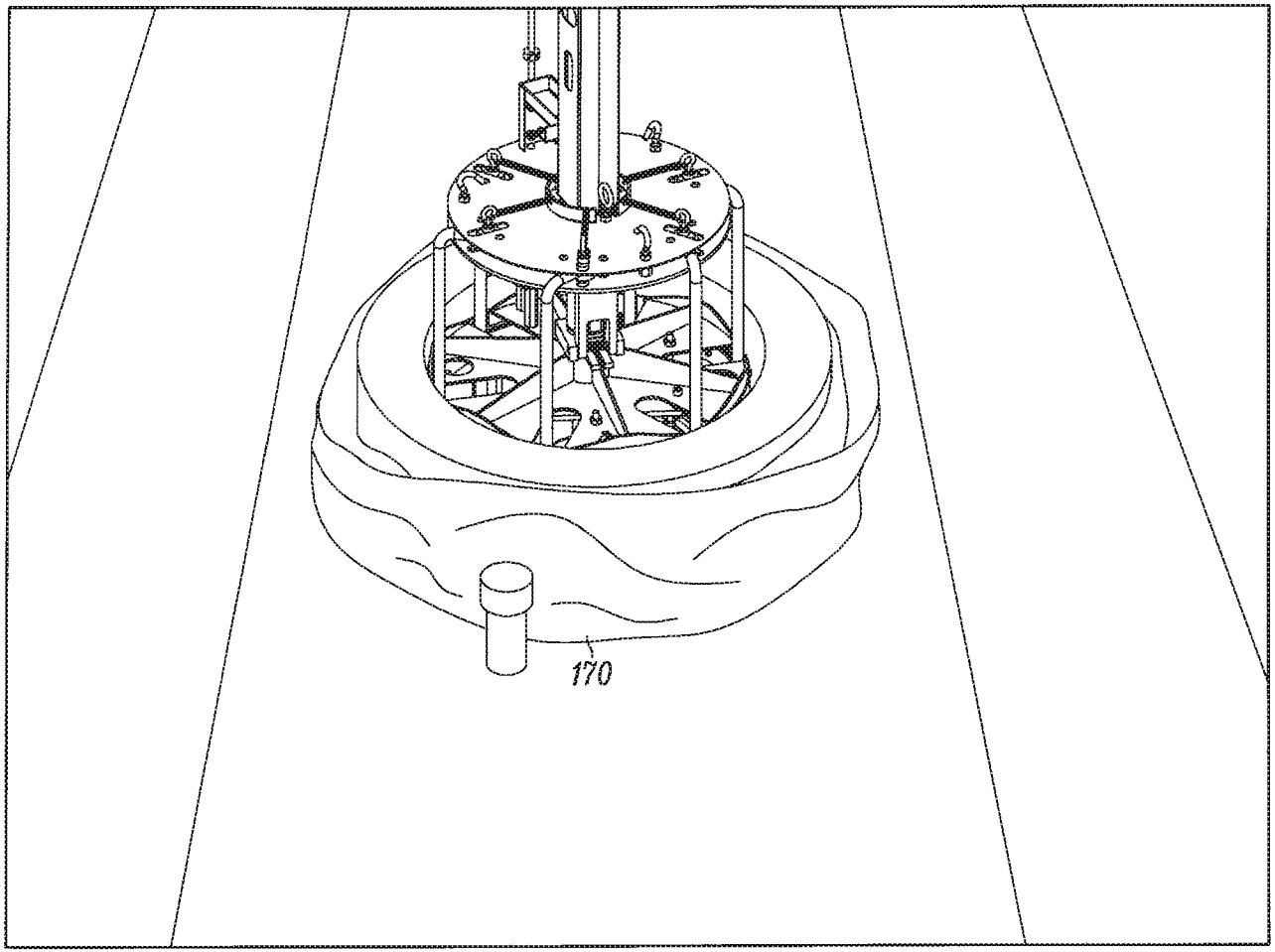
FIG. 20 shows a view of a tile hole with a retrieval tool partially inserted, and a contamination control bag positioned at the opening of the tile hole.
Figure 21:
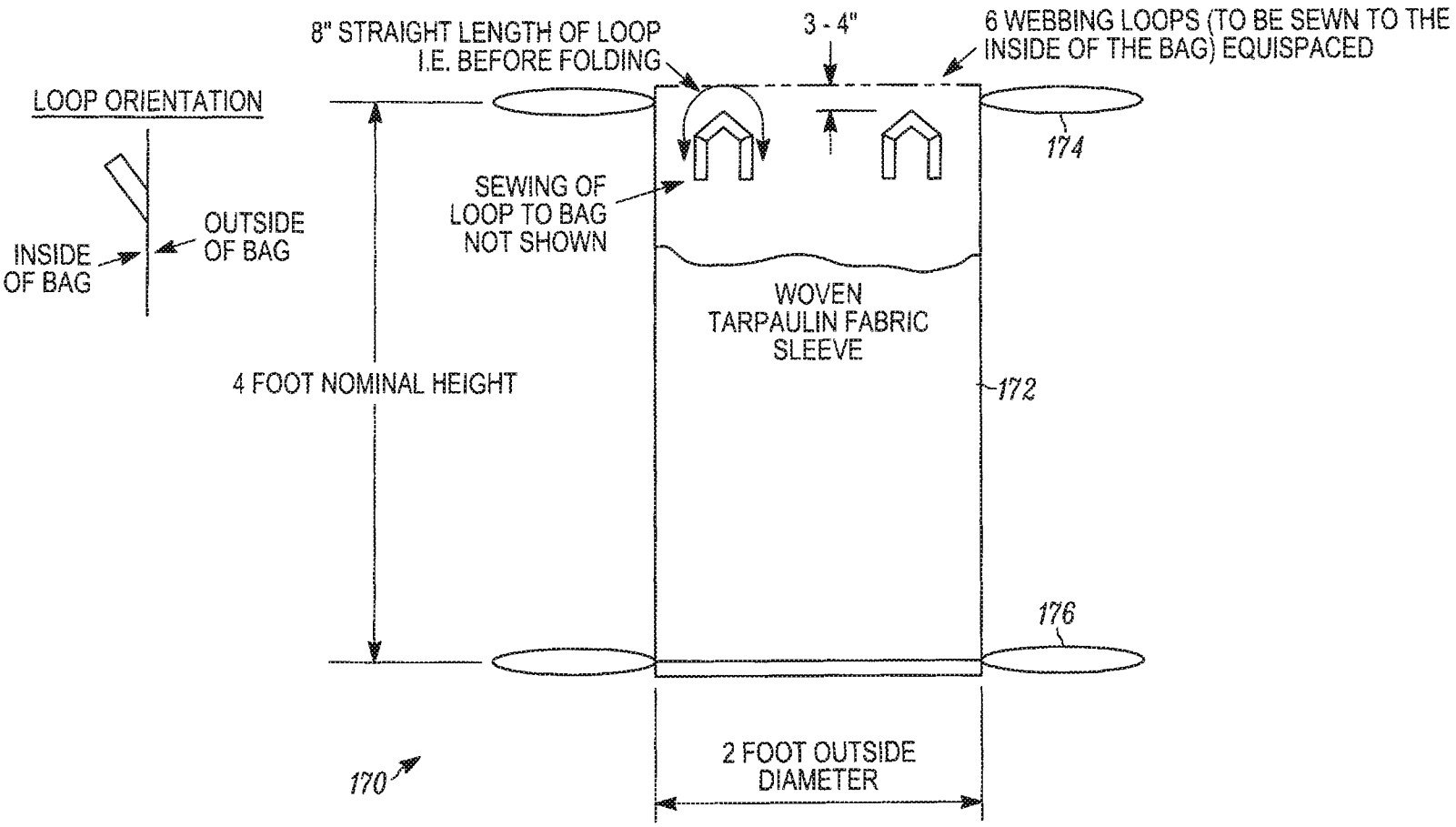
FIG. 21 shows a detail of a contamination control bag in accordance with an embodiment of the present invention.

Prior to the retrieval tool 10 being presented and lowered into the tile hole, via a crane, there are two operations that were deemed to be required. The first requirement is to place a contamination control bag 170 around the protruding tile hole outside diameter. FIG. 20 shows such an operation being performed. The contamination control bag 170 has been added to provide a back-up system to catch any potential debris that may fall from the waste package or the waste container or parts of the waste package, should it disintegrate or break up once the retrieval tool is moved away from the tile hole aperture. A sketch of the contamination control bag 170 used for the proof-of-concept tool is shown in FIG. 21. As shown in this figure, the contamination control bag 170 generally comprises a woven tarpaulin fabric sleeve 172, with drawstrings 174, 176 on both the top and bottom. The woven tarpaulin fabric sleeve 172 has a nominal length of 4'. Six equally spaced loops of 8" in length were sewn to the inside of the woven tarpaulin fabric sleeve 172 to support the drawstrings 174, 176. The contamination control bag 170 was designed to be sufficiently durable to contain a 50 kg waste package. The contamination control bags were used without any issues being raised by the team that used them.

The other operation is to hook the wire leader attached to the waste package to be retrieved, from inside the tile hole and to thread it through the top of the stainless steel cylinder 12 of the retrieval tool 10. The wire leader hook 180 shown in FIG. 22 was designed for this purpose. It is shown in use in FIG. 23. Once the wire leader is passed through the retrieval tool 10, the wire leader can be gently pulled through as the waste package is lifted. The excess wire leader is placed into a receptacle, made from a new pail with a hole in its lid, to minimize the spread of radioactive contamination outside the tile hole.

Figure 18:
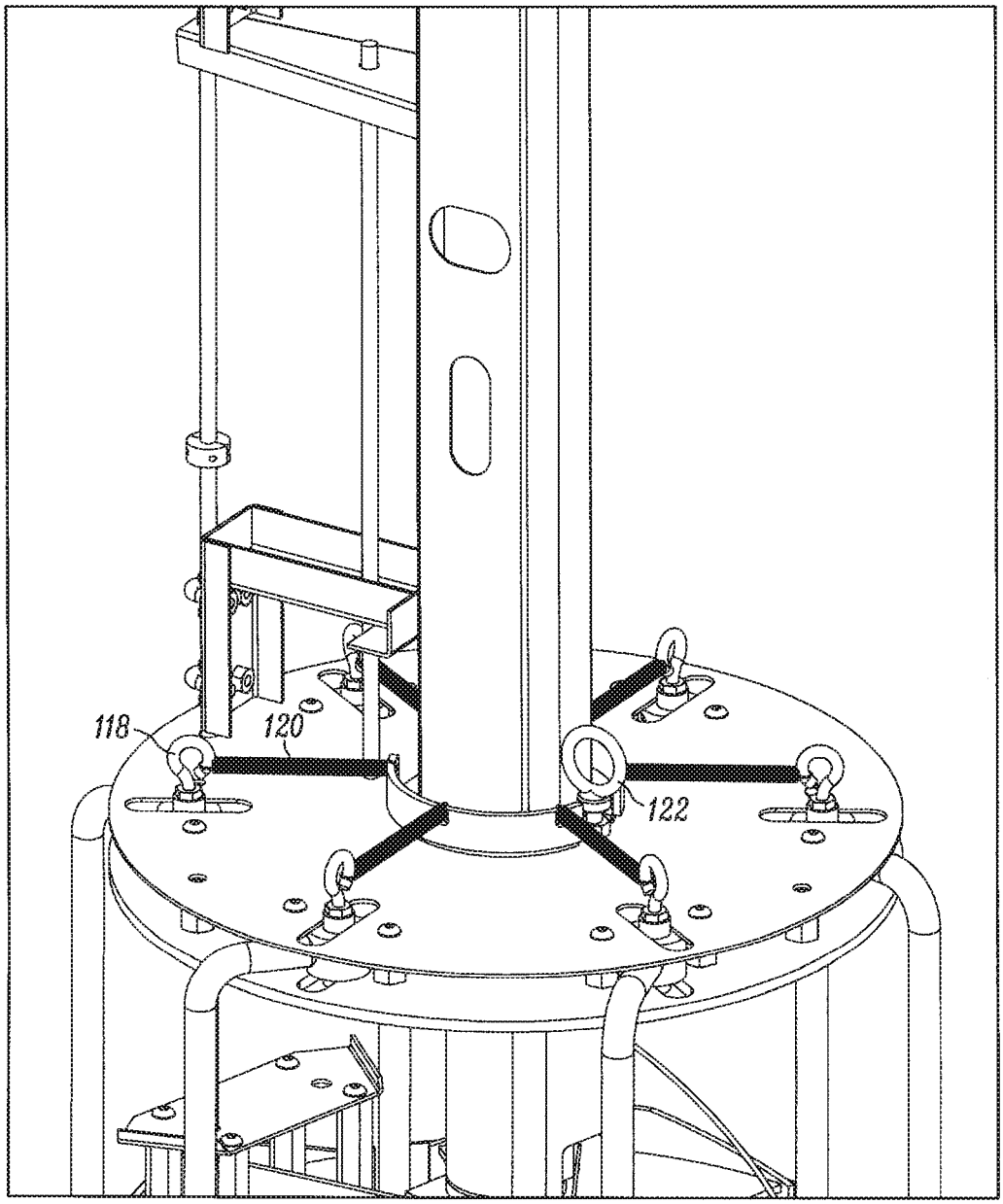
FIG. 18 shows a detailed view of the top of the retrieval tool where the open and closed radial positions of the actuator disk subassembly are visible.
Figure 22:
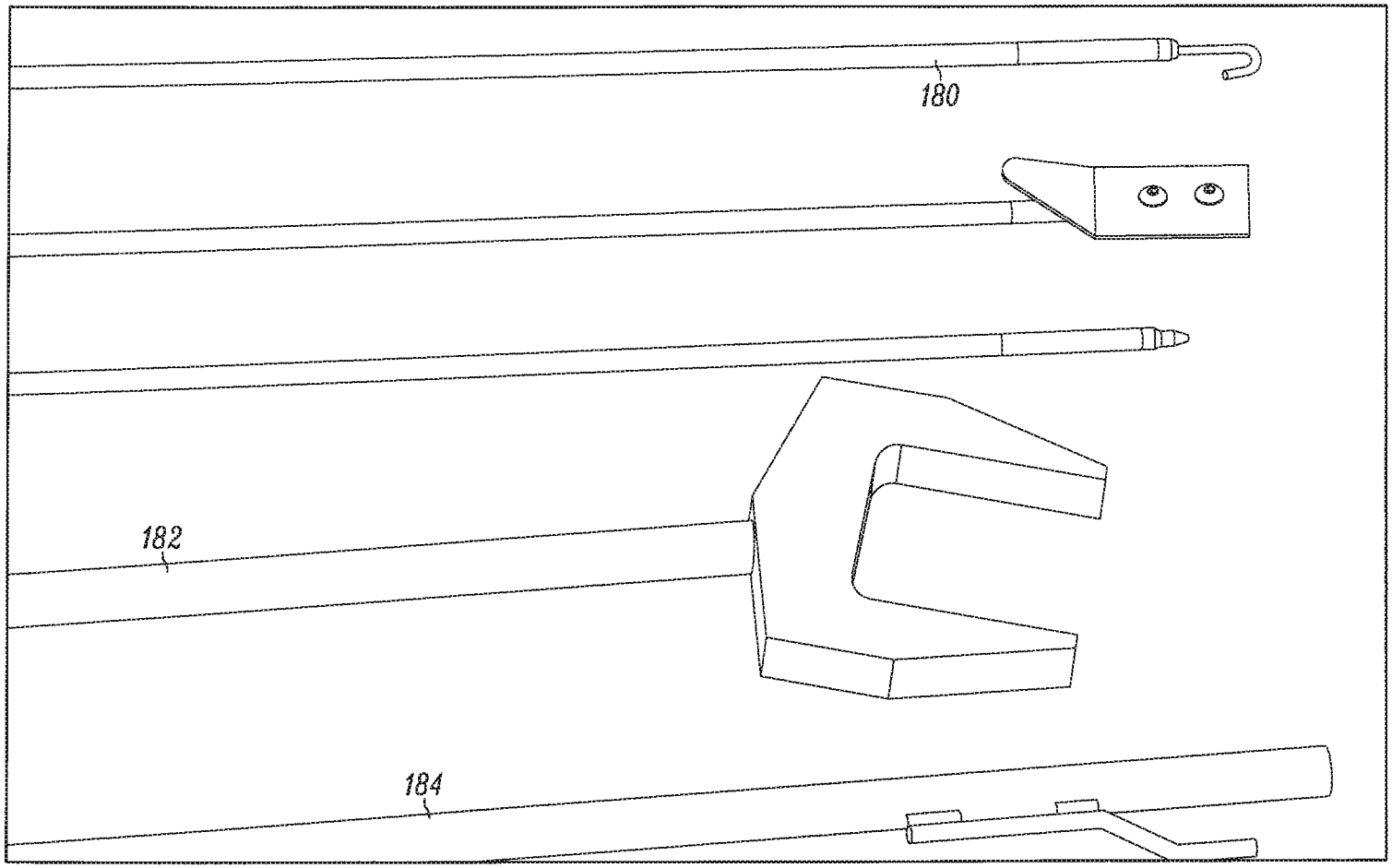
FIG. 22 shows a collection of hand tools for use with the retrieval tool.
Figure 23:
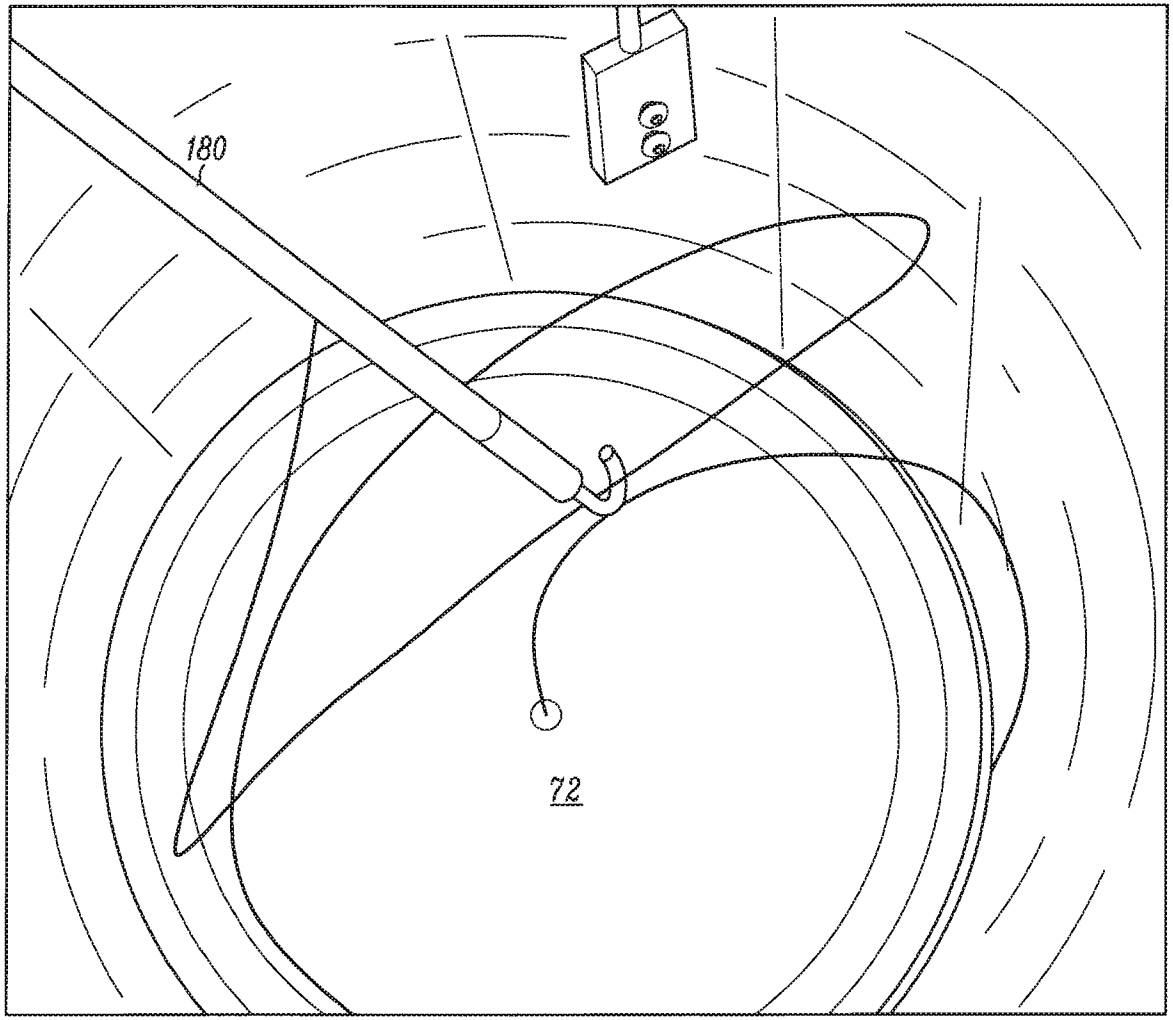
FIG. 23 shows the hooking of a waste package wire using a small hook, which will transfer the wire to the rectangular head of a larger hook tool. The larger hook has a built-in friction device, allowing one end of the cable to be pulled up to the top of the tile hole, yet preventing it from slipping out of the hook.

Before lowering the retrieval tool 10 into the tile hole the actuator disc assembly 26 is set to its raised position and the safety bars 22 are locked into their "open" position. The radial positions of the outer square tube 28 relative to the inner round tube 14 are marked on the retrieval tool 10 as "open" and "closed" as shown by FIG. 18. That is, one or more viewing holes are cut in the outer square tube 28 so that the surface of the inner round tube 14 can be seen. The surface of the inner round tube 14 is then marked up so that the operating position of the actuator disc assembly 26 can be monitored through the viewing holes. A rotating tool 182 as shown in FIG. 22, has been designed for rotating the square tube 28 relative to the round tube 14. As shown, rotating tool 182 looks like a large wrench with a long handle. The open "C" part of this tool fits over the square section of the outer square tube 28. Simultaneously lifting the lock rod 130 out of its current hole, and "jerking" the rotating tool 182 in the correct rotational direction (one direction opens the safety bars and the other direction closes them), rotates the square tube 28 relative to the inner round tube 14. By removing the vertical force lifting the lock rod 130, (once it is out of alignment from its original hole) the square tube rotation can continue until the lock rod 130 falls into its second location hole indicating it has reached the locked "closed" position.

When the retrieval tool 10 is lowered into the tile hole it will eventually come to rest via the stop plate 100 located on the inside of the retrieval tool 10. To avoid having the whole weight of the retrieval tool 10 bearing down onto the top of the waste package to be retrieved, a load limiter 16 containing a reaction spring was incorporated near to the top of the retrieval tool 10 positioned close to the lifting hook 140 to remove the full weight of the retrieval tool 10 from crushing the waste packages within the tile hole. The point at which the retrieval tool 10 makes contact with the top of the waste package to be retrieved is determined with the aid of the video camera 34. The video camera 34 sits in the middle of the stainless steel cylinder 12 of the retrieval tool 10 and points in the vertically downward direction, sitting just above the stop plate 100. By using the live video recording the point in time at which the descent of the retrieval tool 10 stops can be observed. This is when the retrieval tool stop plate 100 makes contact with the waste package. FIG. 7 shows a screen shot taken with the camera during a retrieval. Screen shots and video recordings can be recorded during the retrieval process for subsequent reference if required.

Prior to lowering the retrieval tool 10 over a package, the compressor and vacuum system 32 is switched on to deflate the inflatable air wedges 18 to provide maximum clearance between the retrieval tool 10 and the waste package. At the point in which the retrieval tool 10 has reached its appropriate engagement distance into the tile hole, the inflatable air wedges 18 are inflated by actuating the valves shown in FIG. 11 to the correct position. Pressure is set to provide a maximum value of 2.1 psig. Once the working pressure has been attained, the retrieval tool 10 is then lifted by approximately 1 foot at which point the actuator disc assembly 26 is lowered by releasing the latch 84, via the latch release cable 86, which is shortened by the use of the latch release tool 184 shown in FIG. 22. The latch release tool 184 is simply a fork at the end of a long handle. The fork part of the latch release tool 184 is placed such that the latch release cable 86 is in between the two prongs of the fork. By rotating the latch release tool 184, the latch release cable 86 shortens and eventually the latch 84 pivots sufficiently to allow the actuator disc assembly 26 to drop via gravity. Since the safety bars 22 are connected to the actuator disc 26 they also drop. This allows the six (6) safety bar horizontal arms 24 to tuck under the waste package to act as a back up support in case the waste package and/or its contents fall. The safety bars 22 are locked into their "open" position by using the wrench tool and following the reverse process outlined earlier.

Figure 24:
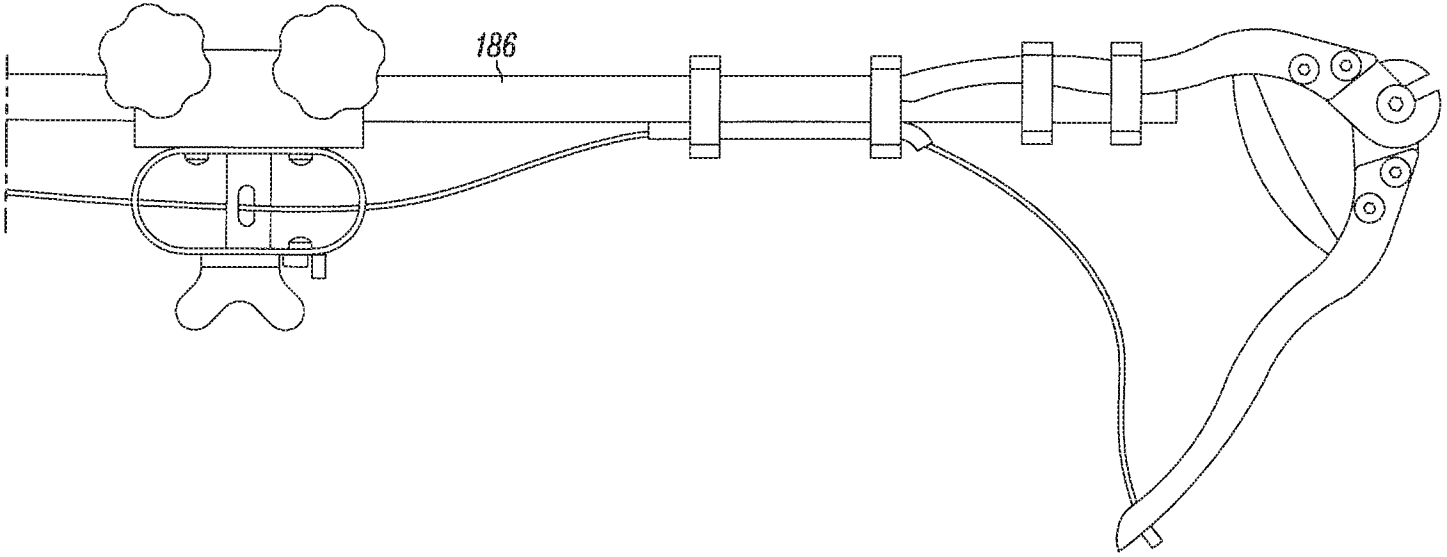
FIG. 24 shows a prototype version of a wire cutter tool.

When the retrieval tool 10 is raised near to the surface, the contamination control bag 170 is hooked onto the retrieval tool 10 with a hand tool, and two cinch cords 176 are pulled in opposite directions to close the bottom of the contamination control bag 170 which is then tied in place. The waste package within the retrieval tool 10 is then transferred with the contamination control bag 170 still hooked to the retrieval tool 10 and is placed into an overpack container for further disposal. In case the wire leader has to be severed inside the tile hole the cutting tool 186 shown in FIG. 24 was developed. In short, this device consists of a pair of wire cutters clamped to a length of rod. The wire cutters can be actuated by pulling on a length of wire cable that is fixed to a handle of the wire cutters, and is guided along the length of rod with suitable guides.

Performance parameters for the described Mark II retrieval tool are as follows:

- load test using 50 kg. Slippage occurred at 1.4 psig. The decision was to use 2.1 psig for field work
- Air pressure delivery system operation <15 psig. A 10 psig over pressure valve has been incorporated into the equipment as per FIG. 11
- Volume of pressurized air=0.75 $ft^3$ (<1.5 $ft^3$)
- Verification was carried out in tile hole array #31
- Inflatable air wedges 18 use 4 inch nominal diameter hose
- The retrieval tool 10 was fabricated to accommodate the retrieval of nine waste packages from a tile hole without having to reconfigure the retrieval tool 10
- Safety bars 22 have been incorporated to provide a mechanical back-up system to support a waste package if the inflatable air wedges 18 cannot hold a waste package
- Appropriate markings have been added to show vertical and radial positions of the safety bars 22
- Inflatable air wedges 18 are retracted via the use of a vacuum pump to provide sufficient radial clearance Easy to use tools have been employed to activate the safety bars 22 and retrieve wire during operation Equipment was designed to be able to retrieve waste packages touching the tile hole wall Lifting equipment followed ASME B30.20-2010 Category A Service Class 0 requirements Equipment was designed to lift packages from tile holes without snagging by having no sharp edges on the outside edges of the retrieval tool a mechanical stop 100 has been incorporated into the design The equipment has been designed to ensure only one waste package can be retrieved at one time by using a stop plate inside the retrieval tool retrieval tool designed for both plastic and steel containers The retrieval tool 10 enables a waste package of 15 to 18 inches height to be retrieved by pre-setting the stop plate The retrieval tool 10 enables a waste package of diameter 10 to 13 inches to be retrieved The retrieval tool 10 has been designed to fit inside a tile hole of 14.775/15.225 inches in diameter The retrieval tool 10 has been designed to fit inside a tile hole of 15 feet 11 inches in depth A means to cut and remove wires attached to waste packages without damage to packages has been developed Operation of retrieval tool 10 was designed to keep operators away from the tile hole opening using ALARA principles The retrieval tool 10 incorporates a video camera 34 retrieval tool 10 has been designed to have a clearance fit inside the tile hole to prevent tool hang up Testing for Validation and Training A number of commissioning tests were carried out. One of the commissioning tests included the ability of the air wedges to support a full load. A successful test was carried out and documented. This test assisted in setting the working pressure of the air wedges, set at 2.1 psig, and provided a significant safety factor for subsequent demonstrations and future development testing.

The first meeting to demonstrate the Mark II retrieval tooling took place in Chalk River Laboratories B456 facility on 2011 Sep. 28. From the initial demonstration, a draft Operating Instruction was compiled and used for a number of subsequent demonstrations and training sessions led by the operations team that also involved riggers and crane operators. The feedback from all participants assisted in developing the Operating Instruction for the next phases of training and testing.

The next phase of testing was carried out on a new tile hole using inactive packages on two separate days 2011 Sep. 22 and 29. When the retrieval tool was initially placed into the tile hole aperture it was noted there was not a significant amount of clearance between the outer part of the retrieval tool and the inside of the tile hole. With the aid of some rotation and shaking, the retrieval tool dropped into the tile hole and once past the entrance descended with ease. It was later noted that the entrance to the tile hole appeared to be reduced compared to the general diameter of the tile hole.

There are up to nine packages contained within a tile hole and the designated numbering system is that package #1 is at the bottom and #9 is at the top of the tile hole. Packages #8 and #9 were removed with no unusual events and the decontamination control bag worked as expected.

However, a problem did occur when retrieving waste package #7. It was observed that the retrieval tool would not drop sufficiently over waste package #7. Two likely reasons for this included:

1. The eccentricity between the two pipes, that form the tile hole, restricted the effective working diameter within the tile hole.
2. The fingers of the retrieval tool which are used to move the waste package from the side of the tile hole surface got trapped in the interconnecting gap between the tile hole pipes.

On 2011 Oct. 19, a series of five tiles holes located in a different array than that of the planned retrievals were opened and measured, the tile holes being found to have a narrower diameter than the design specification of the retrieval tool. Despite the discrepancy, the functionality of the retrieval tool was still found to be effective. The top of these tile holes ranged from 14.44" diameter to 14.75" diameter (below the minimum tolerance of 14.75"). The tool was then modified by grinding the heads of the screws on the periphery of the retrieval tool body, and the modified tool was then tried in each of the five tile holes. The tool entered three of the five tile holes without difficulty including the initial test hole, and was stopped halfway down one of the tile holes by a projecting lump of concrete spatter.

It should be noted that the overriding objective was to validate the proof-of-concept tooling. The heart of the retrieval tooling is the application of inflatable surfaces to limit the radial forces acting on the waste containers and this aspect worked well. The issue of fitting the retrieval tool inside the tile hole can in part be accommodated by reducing the outside diameter of the retrieval tool if the retrieval tool is needed for future retrievals.

The two main issues from field trials were:

The clearance between the outside diameter of the retrieval tool 10 and the inside effective diameter of tile hole, and The centering fingers catching in the gap between the two concrete pipes that form the tile hole.

Options to reduce the outside diameter of the retrieval tool 10 include the following:

For the short term:

Grind off most of the heads of all of the protruding screws from the outer surface of the retrieval tool and retest in the same tile hole as per previous tests.

For the longer term:

Use stronger material for the safety bars, e.g. austempered metal that offers 8 to 10 times more material strength. This will allow the safety bar diameter to be reduced from the current 0.5 inch diameter to 0.375 or even 0.25 inch diameter saving up to 0.5 inches on external diameter of the retrieval tool 10.

Replace the protrusion of existing button head screws with another option e.g. rivets. Likely saving 0.25 inch on the outside diameter of the retrieval tool 10.

Locate the collar connecting the lower and upper parts of the retrieval tool 10 on the inside of the retrieval tool 10 rather than on the outside as per the current design saving a further 0.25 inch on the outside diameter of the retrieval tool 10.

Options to avoid "snagging" of the centering fingers include:

Using a pole to gently pry the waste package from the surface of the tile hole wall. If the waste package can be moved, lower the retrieval tool 10 into place with safety bars open but not locked. This may allow the fingers to pass the tile hole joint.

Using the retrieval tool 10 to move the package from the wall of the tile hole wall, as per the current method, but gently pulling the waste package cable to aid centering of the waste package.

Mark III Version

As noted above, the principles of the invention may be applied to various types of waste packages and tile hole arrangements. In this regard, a Mark III retrieval tool was developed to accommodate a slightly different, and more durable, type of waste package. Specifically, the Mark III design addresses a scenario where:

- the waste package in question is a metal bodied one, which is considerably more robust than the plastic ones lifted with the Mark II retrieval tool.
- the lid of the waste package has a metal clasp which projects radially outwards from the body, increasing the effective diameter of the waste package.
- The maximum waste package mass is 25 Kg, rather than the 50 Kg ones lifted by the Mark II retrieval tool.
- The tile hole was fabricated from a metric series of concrete pipe, and is marginally (say ¼") smaller.

This scenario allowed the number of air wedges and safety bars to be reduced. It also allowed changes to be made to the opening into the retrieval tool, and the deflation system for the inflatable air wedges. These changes simplified the design of the retrieval tool and reduced the cost of fabrication.

Figure 25:
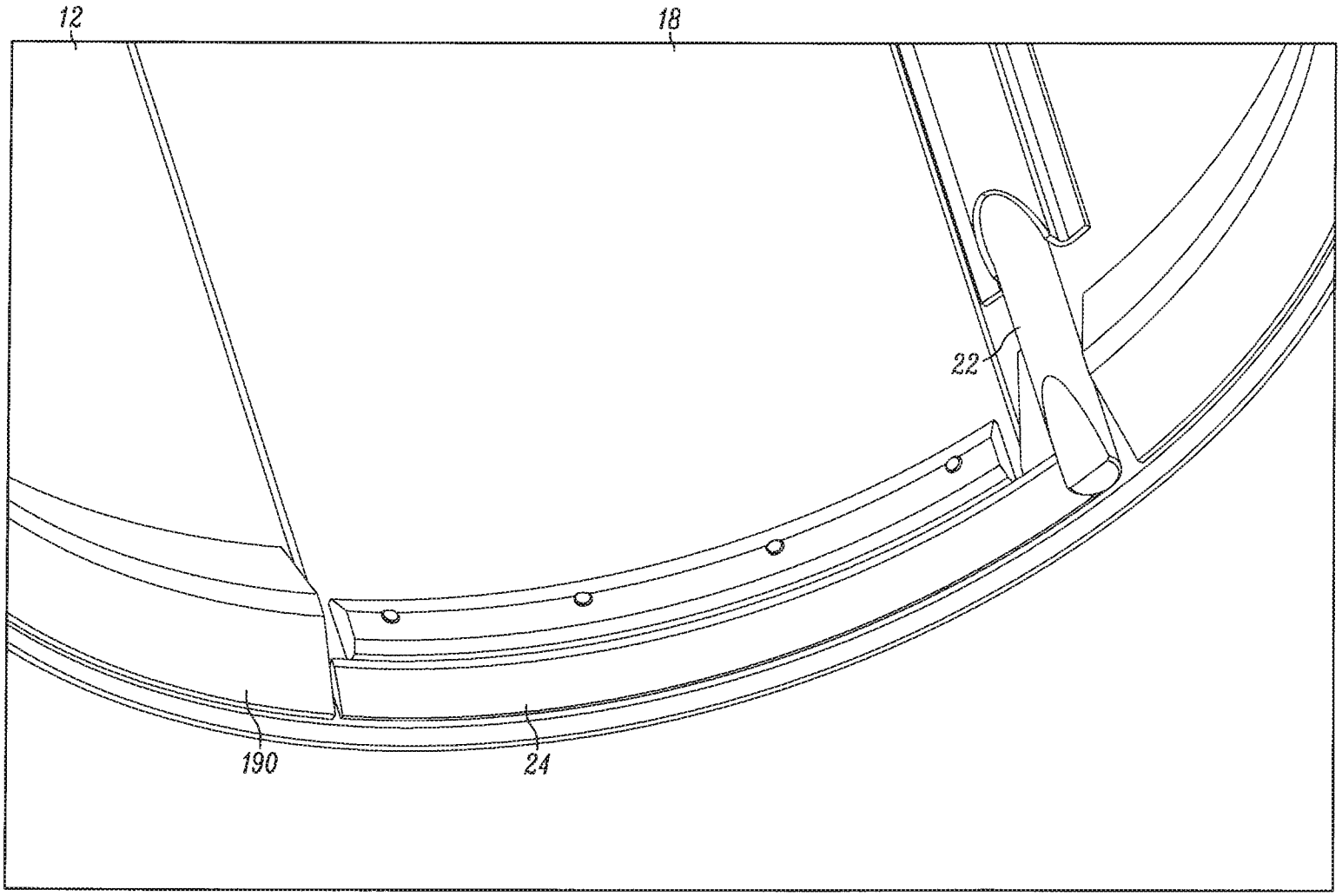
FIG. 25 shows a photograph of the lower end of the Mark III retrieval tool.
Figure 26:
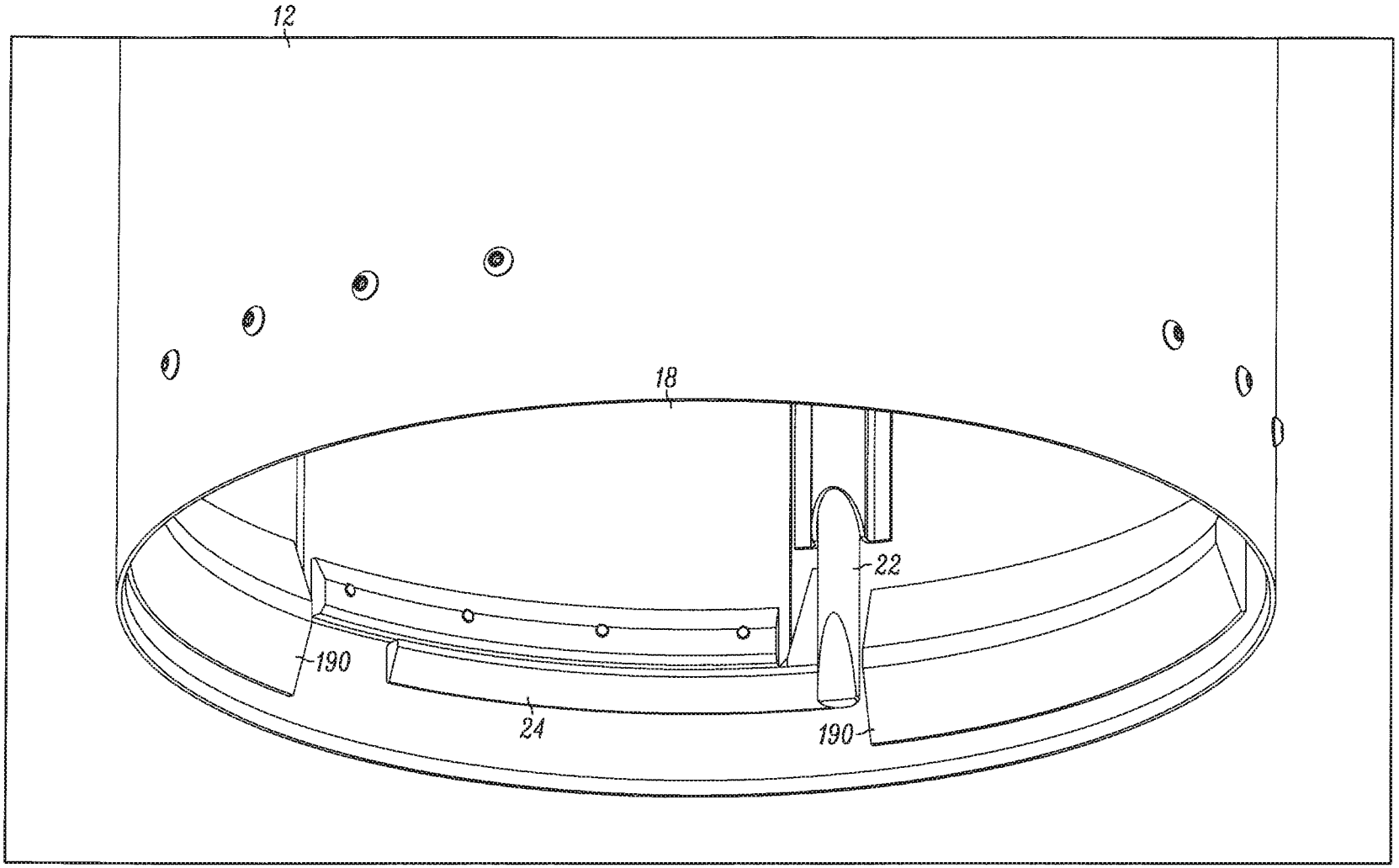
FIG. 26 shows a drawing of the lower end of the Mark III retrieval tool, from a perspective similar to that of FIG. 25.
Figure 27:
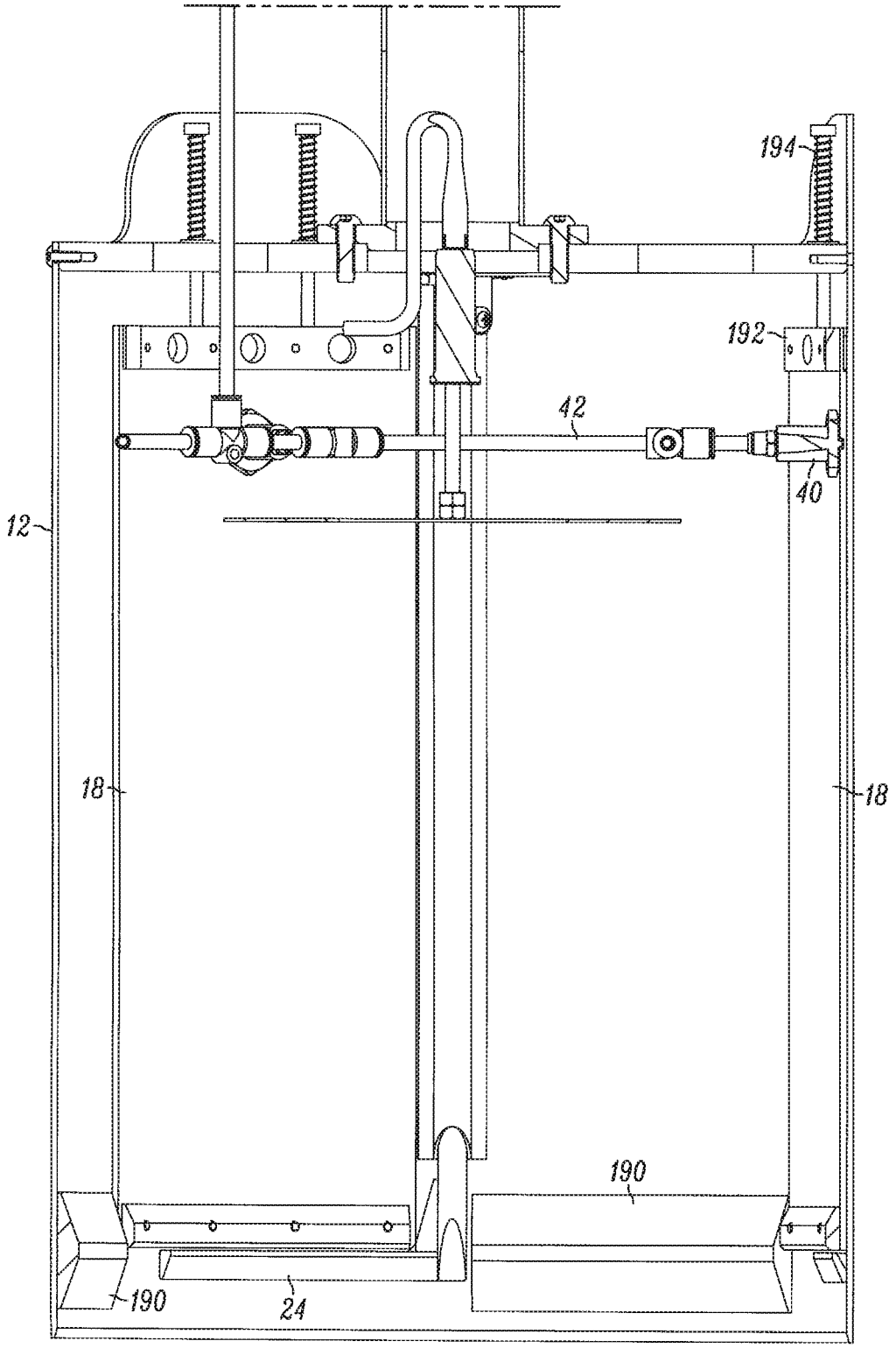
FIG. 27 shows a cross-sectional drawing of the Mark III retrieval tool.

As shown in FIGS. 25 to 27, the number of inflatable air wedges 18 was reduced to three, and the number of rotatable safety bars 22/safety bar horizontal arms 24 was reduced to three. The same size of inflatable hose was used as in the Mark II retrieval tool, with the three inflatable air wedges 18 spaced evenly around the circumference of the stainless steel cylinder 12. Similarly, the three rotatable safety bars 22 were evenly spaced around the circumference of the stainless steel cylinder 12. Although this decreased the percentage of surface area that is covered on the inside of the stainless steel cylinder 12, the Mark III design was still found to be effective with the more robust waste containers.

The issue of how much of the stainless steel cylinder 12 surface to cover with inflatable air wedges 18 is a matter of balancing the fragility of the waste package with the desire to reduce complexity. At one extreme a small number of inflatable air wedges 18 would result in a small number of higher pressure, discrete pressure points, while at the other extreme, a large coverage area of inflatable air wedges 18 would result in lower pressure, uniform loading. The Mark II was successful since it applied this uniform pressure, allowing the circular cross section of the waste package to act in like a masonry arch. All elements of the waste package were in uniform compression, so they did not fail.

The Mark III scenario allows the luxury of a waste package which would allow discrete pressure points. Although the inflatable air wedges 18 in the Mark III design place compression forces at more discrete points, enough friction is established to lift the waste package without damaging it.

Generally, the retrieval tool would be designed with a correlation between the number of inflatable air wedges 18 and the number of rotatable safety bars 22. Typically, the same number of each would be used so that they do not interfere with one another, though one could use twice as many air wedges as safety rods, or vice versa. For example, one could place two inflatable air wedges between each safety rod.

In the Mark III design, the triangular shaped metal fingers 20 were not used as it was found that using a stainless steel cylinder 12 with a tapered leading edge was sufficient and more practical. Since the waste packages are more robust for the Mark III retrieval tool, it was acceptable to use a greater force rather than finesse to get the retrieval tool over the waste package Eliminating the triangular shaped metal fingers 20 reduces complexity, and makes the tool itself more robust.

As shown in FIGS. 26 and 27, all of the components in the opening to the stainless-steel cylinder 12 were designed with a tapered leading edge: the leading edge of the rotatable safety bars 22, the safety bar horizontal arms 24, and the cylinder strengthening members 190.

Figure 28:
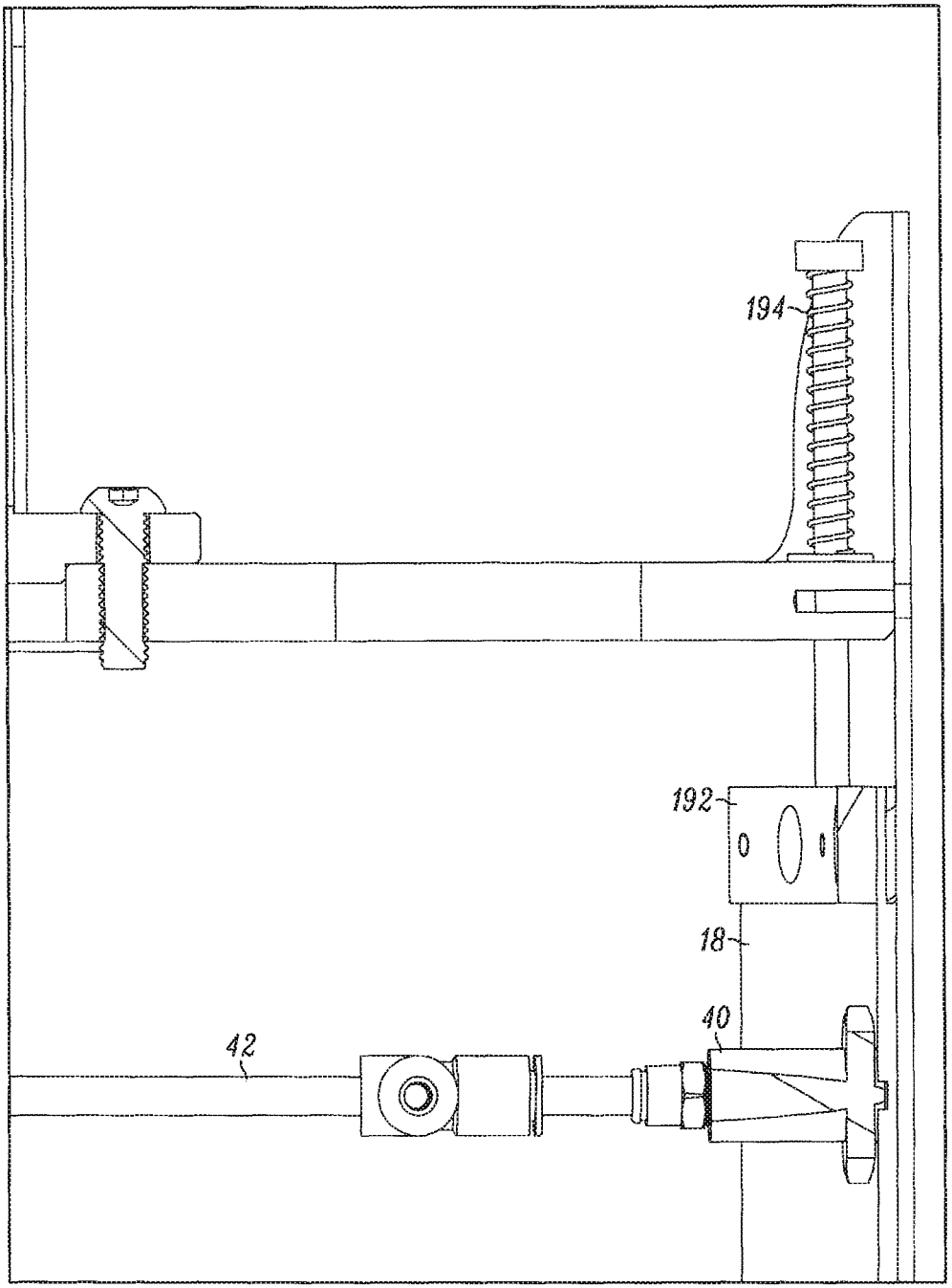
FIG. 28 shows a partial, enlarged view of the cross-sectional drawing of the Mark III retrieval tool of FIG. 27, showing the details of the upper end of the inflatable air wedges in this embodiment of the invention.

Finally, the use of a vacuum to collapse the inflatable air wedges was eliminated from the Mark III design in favor of a spring-loaded air wedge mounting design. As shown in FIG. 27 and in the enlarged view of FIG. 28, the upper ends of the inflatable air wedges 18 were not bolted to the sides of the stainless steel cylinder 12 as in the case of the Mark II design. Rather, the clamps 192 on upper ends of the inflatable air wedges 18 were connected to spring loaded supports 194 providing a vertical pull on the inflatable air wedges 18. This allows the length of the inflatable air wedges 18 to vary between the deflated to inflated conditions, eliminating the need for a sliding sleeve arrangement found in the Mark II design. When the flow of compressed air to the inflatable air wedges 18 is stopped and the inflatable air wedges 18 are allowed to deflate, the vertical pull from the spring loaded supports 194 will cause the inflatable air wedges 18 to flatten, forcing the air out of them. With this arrangement, it is not necessary to provide a vacuum pump.

Options and Alternatives

Many variations to the described system are possible. Examples of variations include:

- changing the materials of construction;
- allowing the air wedges to deflate naturally without applying a vacuum;
- modifying the retrieval tool 10 to retrieve more than one waste package; and
- making use of electric or pneumatic actuators to allow opening and closing of the rotatable safety bars 22 remotely.

Other changes and variations also follow logically from the description herein, particularly to accommodate the design of specific tile holes and/or waste packages.

CONCLUSIONS

One or more currently preferred embodiments have been described by way of example. It will be apparent to persons skilled in the art that a number of variations and modifications can be made without departing from the scope of the invention as defined in the claims.

All citations are hereby incorporated by reference.

What is claimed is:

1. A tool for retrieving contents from a hole comprising:

a cylindrical body having:

a larger internal diameter than an external diameter of said contents; and a smaller external diameter than an internal diameter of said hole;

a plurality of inflatable air wedges arranged about the inside of said cylindrical body, each of said plurality of inflatable air wedges having a first end fixed to an inside wall of said cylindrical body at a top region of said cylindrical body and a second end fixed to the inside wall of said cylindrical body at a bottom region of said cylindrical body, and being operable to be inflated to grip the periphery of said contents;

a source of pressurized air to controllably inflate said plurality of inflatable air wedges;

a vertical lifting assembly fixed to the top of said cylindrical body for lowering said cylindrical body into said hole, and raising said cylindrical body out of said hole; and wherein each of said plurality of inflatable air wedges is fixed to the inside wall of said cylindrical body at said first end and said second end with upper and lower arcuate clamps.

2. The tool of claim 1 further comprising multiple safety bars movably fixed to said cylindrical body, said multiple safety bars being operable to be rotated from a stowed position in which they align with a horizontal cross-section of the cylindrical body, to a deployed position in which they are beneath said contents.

3. The tool of claim 2, wherein said vertical lifting assembly comprises a vertical lifting tube with a fitting for suspending said vertical lifting tube from a crane.

4. The tool of claim 3 further comprising spring loaded fingers at an opening in a bottom of said cylindrical body, to urge said contents from the walls of said tile hole and into said opening in the bottom of said cylindrical body.

5. The tool of claim 3, wherein an opening of said cylindrical body is tapered, to urge said cylindrical container into the opening in the bottom of said cylindrical body.

6. The tool of claim 3, wherein said source of pressurized air comprises a compressor and vacuum supply system.

7. The tool of claim 3, wherein said source of pressurized air comprises a compressor system.

8. The tool of claim 3, wherein each of said multiple safety bars comprises a horizontal arm and a vertical, rotatable actuating rod fixed to said horizontal arm, and the tool further comprises a rotatable actuator plate having a first position of rotation in which said multiple safety bars are rotated to a stowed position, and a second position of rotation in which said safety bars are rotated to a deployed position.

9. The tool of claim 8 wherein said actuator plate has a raised position in which said horizontal arms are recessed within said cylindrical body, and a lowered position in which said horizontal arms drop below the bottom of said cylindrical body.

10. The tool of claim 9 further comprising a second vertical tube coaxial with said vertical lifting tube, said second vertical tube being fixed to said rotatable actuator plate whereby rotation of said second vertical tube allows rotation of said rotatable actuator plate to said first position of rotation and said second position of rotation.

11. The tool of claim 6 wherein said compressor and vacuum supply system is operable to supply a vacuum to said inflatable air wedges, to deflate said inflatable air wedges.

12. The tool of claim 7 wherein said inflatable air wedges are fixed to said cylindrical body with spring loaded supports, causing said inflatable air wedges to deflate when the source of pressurized air ceases.

13. The tool of claim 3, wherein said contents comprises cylindrical waste packages.

14. The tool of claim 3, wherein said hole comprises a tile hole.

15. The tool of claim 3, wherein said plurality of inflatable air wedges comprises six inflatable air wedges.

16. A waste package retrieval system for retrieving waste packages from a tile hole comprising:

a cylindrical body having:

a larger internal diameter than an external diameter of said waste packages; and a smaller external diameter than an internal diameter of said tile hole;

a plurality of inflatable air wedges arranged about the inside of said cylindrical body, each of said plurality of inflatable air wedges having a first end fixed to an inside wall of said cylindrical body at a top region of said cylindrical body and a second end fixed to the inside wall of said cylindrical body at a bottom region of said cylindrical body, and being operable to be inflated to grip the periphery of said waste packages;

a compressor system to controllably inflate said plurality of inflatable air wedges;

a vertical lifting tube fixed to the top of said cylindrical body, with a fitting for suspending said vertical lifting tube from a crane, for lowering said cylindrical body into said hole and raising it out of said tile hole; and wherein each of said plurality of inflatable air wedges is fixed to the inside wall of said cylindrical body at said first end and said second end with upper and lower arcuate clamps.

17. A method of retrieving a cylindrical container from a tile hole comprising:

suspending a vertical lifting assembly from a crane;

suspending a cylindrical body from said vertical lifting assembly, said cylindrical body having a larger internal diameter than an external diameter of said cylindrical container; and a smaller external diameter than an internal diameter of said tile hole;

lowering said cylindrical body over said cylindrical container in said tile hole;

inflating a plurality of air wedges arranged about the inside of said cylindrical body, each of said plurality of air wedges having a first end fixed to an inside wall of said cylindrical body at a top region of said cylindrical body and a second end fixed to the inside wall of said cylindrical body at a bottom region, to grip the periphery of said cylindrical container, wherein each of said plurality of air wedges is fixed to the inside wall of said cylindrical body at said first end and said second end with upper and lower arcuate clamps; and lifting said cylindrical container the remaining distance out of said tile hole.

18. The method of claim 17 further comprising:

lifting said cylindrical container with said cylindrical body and inflated air wedges, a small distance; and rotating multiple safety bars movably fixed to said cylindrical body, from a stowed position in which they align with a horizontal cross-section of the cylindrical body, to a deployed position in which they are beneath said cylindrical container.

19. The method of claim 17, further comprising: urging said cylindrical container from the walls of said tile hole and into an opening in the bottom of said cylindrical body by means of spring loaded fingers positioned at the opening of said cylindrical body.

20. The method of claim 19 further comprising deflating said inflatable air wedges using a vacuum source.

21. The tool of claim 1, wherein each of said plurality of inflatable air wedges comprises a length of hose, said upper and lower arcuate clamps sealing ends of said length of hose.

22. The tool of claim 1, wherein said cylindrical body comprises first and second co-axial cylinders in a sliding sleeve arrangement, the first end of each of said inflatable air wedges being fixed to said first co-axial cylinder, and the second end of each of said inflatable air wedges being fixed to said second co-axial cylinder, the first and second co-axial cylinders sliding relative to one another as determined by the inflatable air wedges as they are inflated and deflated.

23. The tool of claim 2, wherein said multiple safety bars further comprise springs biasing said multiple safety bars to said deployed position in which they are beneath said contents.

24. The tool of claim 8, further comprising a lock rod guided by brackets, said lock rod which can be fed through a hole in said rotatable actuator plate, fixing said rotatable actuator plate in position and holding said multiple safety bars in said deployed position.

* * * * *